US006999886B2

(12) United States Patent
Hilliard

(10) Patent No.: US 6,999,886 B2
(45) Date of Patent: Feb. 14, 2006

(54) VEHICLE SPEED ESTIMATION USING INDUCTIVE VEHICLE DETECTION SYSTEMS

(75) Inventor: Steven R. Hilliard, Knoxville, TN (US)

(73) Assignee: Inductive Signature Technologies, Inc., Knoxville, TN (US)

( * ) Notice: Subject to any disclaimer, the term of this patent is extended or adjusted under 35 U.S.C. 154(b) by 117 days.

(21) Appl. No.: 10/664,319

(22) Filed: Sep. 17, 2003

(65) Prior Publication Data

US 2004/0056778 A1 Mar. 25, 2004

Related U.S. Application Data

(60) Provisional application No. 60/411,320, filed on Sep. 17, 2002.

(51) Int. Cl.
*G08G 1/01* (2006.01)

(52) U.S. Cl. ..... 702/82; 702/96; 702/97; 702/104; 702/142; 701/119; 340/933

(58) Field of Classification Search ..... 702/82, 702/57, 96, 97, 104, 142; 701/119, 117; 340/936, 340/938, 939, 941, 933
See application file for complete search history.

(56) References Cited

U.S. PATENT DOCUMENTS 3,983,531 A 9/1976 Corrigan
4,296,401 A 10/1981 Duley
4,368,428 A 1/1983 Dijkman
5,278,555 A 1/1994 Hoekman
5,298,738 A 3/1994 Gebert et al.
5,455,768 A 10/1995 Johnson et al.
5,491,475 A 2/1996 Rouse et al.
5,508,698 A 4/1996 Hoekman
5,528,234 A 6/1996 Mani et al.
5,801,943 A 9/1998 Nasburg
6,483,443 B1 11/2002 Lees et al.

OTHER PUBLICATIONS

Seri Oh, Stephen G. Ritchie, Cheol Oh; Real Time Traffic Measurement From Single Loop Inductive Signatures; Submitted for presentation and publication at the 81st annual meeting of the Transportation Research Board—Jan. 13–17, 2002 Washington D.C. (15 pp).

*Primary Examiner*—Bryan Bui
*Assistant Examiner*—Hien Vo
(74) *Attorney, Agent, or Firm*—Pitts & Brittian, P.C.

(57) ABSTRACT

A method and apparatus for communicating estimated vehicular speed and length using data obtained from a single wire-loop. The detector card connected to a single wire-loop produces a first bivalent output based on the actual measurement of a vehicle at the wire-loop sensor and synthesizes a second bivalent output to mimic the output of a two wire-loop speed trap. By simulating a second bivalent output at the detector card level, a conventional field controller is capable of estimating the vehicular speed from a single wire-loop sensor.

10 Claims, 25 Drawing Sheets

VEHICLE SPEED ESTIMATION USING INDUCTIVE VEHICLE DETECTION SYSTEMS

CROSS-REFERENCE TO RELATED APPLICATIONS

This application claims the benefit of U.S. Provisional Application No. 60/411,320 filed Sep. 17, 2002.

STATEMENT REGARDING FEDERALLY SPONSORED RESEARCH OR DEVELOPMENT

Not Applicable.

COMPUTER PROGRAM LISTING APPENDIX

The computer program listing appendix contained on compact disc submitted herewith, in duplicate, containing the files identified below is incorporated by reference. A portion of the disclosure of this patent document contains material which is subject to copyright protection. The copyright owner has no objection to anyone reproducing the patent disclosure, as it appears in the Patent and Trademark Office patent files or records, but otherwise reserves all copyright rights whatsoever.

LIST OF FILES

| Name | Location | Size (Bytes) | Creation Date |
|---|---|---|---|
| DiagLogger.cpp | \ | 2,267 | Tue Sep. 16 17:04:40 2003 |
| DiagLogger.h | \ | 503 | Tue Sep. 16 17:04:40 2003 |
| ISTSync.h | \ | 4,556 | Tue Sep. 16 17:04:40 2003 |
| ISTThread.cpp | \ | 1,240 | Tue Sep. 16 17:04:40 2003 |
| ISTThread.h | \ | 519 | Tue Sep. 16 17:04:40 2003 |
| DAQFile.cpp | \ | 3,249 | Tue Sep. 16 17:04:40 2003 |
| DAQFile.h | \ | 2,817 | Tue Sep. 16 17:04:40 2003 |
| DiagDAQ.cpp | \ | 13,313 | Tue Sep. 16 17:04:40 2003 |
| DiagDetect.cpp | \ | 3,579 | Tue Sep. 16 17:04:40 2003 |
| DiagDetect.h | \ | 561 | Tue Sep. 16 17:04:40 2003 |

BACKGROUND OF THE INVENTION

1. Field of Invention

This invention relates to uses for inductive vehicle detection systems. More specifically, this invention describes a method for using a single-loop inductive sensor to estimate vehicular speed and length, and to communicate the speed and length information to a traffic controller.

2. Description of the Related Art

Numerous inductive vehicle detection systems have been installed in roadways around this nation. A conventional inductive vehicle detection system is a combination of wire-loop sensors, detector cards, and controller cards, which cooperate to obtain data on vehicles passing through the field of detection. Many of these inductive vehicle detection system installations use only a single wire-loop in any given traffic lane. In these conventional inductive vehicle detection systems, the amount of information available depends upon the configuration of the inductive vehicle detection system. Typically, obtaining a reliable measurement of vehicular speed requires two sequential wire-loops separated by a known fixed distance. Using arrival time and the distance between the wire-loop sensors, the vehicle speed is calculated. More recently, analysis methods have provided a way to estimate vehicular speed using data from a single wire-loop. However, in their present form, the single wire-loop vehicle speed analysis methods require a complete retrofitting of the detector cards and the controller card. The controller card is typically the most expensive component of the inductive vehicle detection system. There is a need to find a way to employ the single wire-loop vehicle speed analysis methods that makes better use of existing components of existing inductive vehicle detection systems, particularly the controller card.

BRIEF SUMMARY OF THE INVENTION

An inductive loop detector card is connected to a single wire-loop sensor in a traffic lane. The detector card produces a first bivalent output based on the actual measurement of a vehicle at the wire-loop sensor and synthesizes a second bivalent output to mimic the output of a two wire-loop speed trap. A data processor onboard the detector card estimates the speed using an algorithm similar to that described by Oh, et al. Though the virtual wire-loop sensor does not physically exist, it is possible to infer a bivalent output pulse for this virtual wire-loop, as if it did physically exist, from the inferred speed and known lane occupancy of a detected vehicle over the single wire-loop sensor. Commonly used field controllers can readily interpret the speed and lane occupancy information encoded in the two bivalent output pulses of the present invention. By simulating a second bivalent output at the detector card level, a conventional field controller is capable of estimating the vehicular speed from a single wire-loop sensor.

BRIEF DESCRIPTION OF THE SEVERAL VIEWS OF THE DRAWINGS

The above-mentioned features of the invention will become more clearly understood from the following detailed description of the invention read together with the drawings in which.

DETAILED DESCRIPTION OF THE INVENTION

A. Mobile Inductive Loop Sensor

Figure 1:
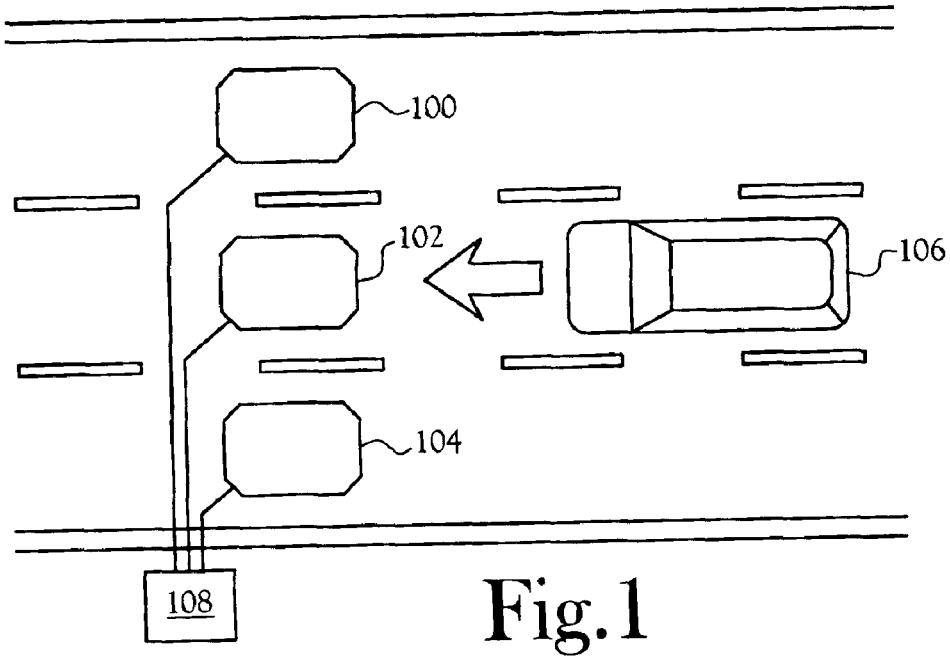
Fig.1 (PRIOR ART)
FIG. 1 illustrates an inductive sensor installation according to the prior art.

Inductive vehicle detectors 100, 102, 104 of the prior art are typically placed in fixed locations, and vehicle traffic 106 is detected as it moves past the fixed-point sensors 100, 102, 104, as illustrated in FIG. 1. The inductance measurements are processed and/or recorded in circuitry 108 located in a remote location.

Figure 2:
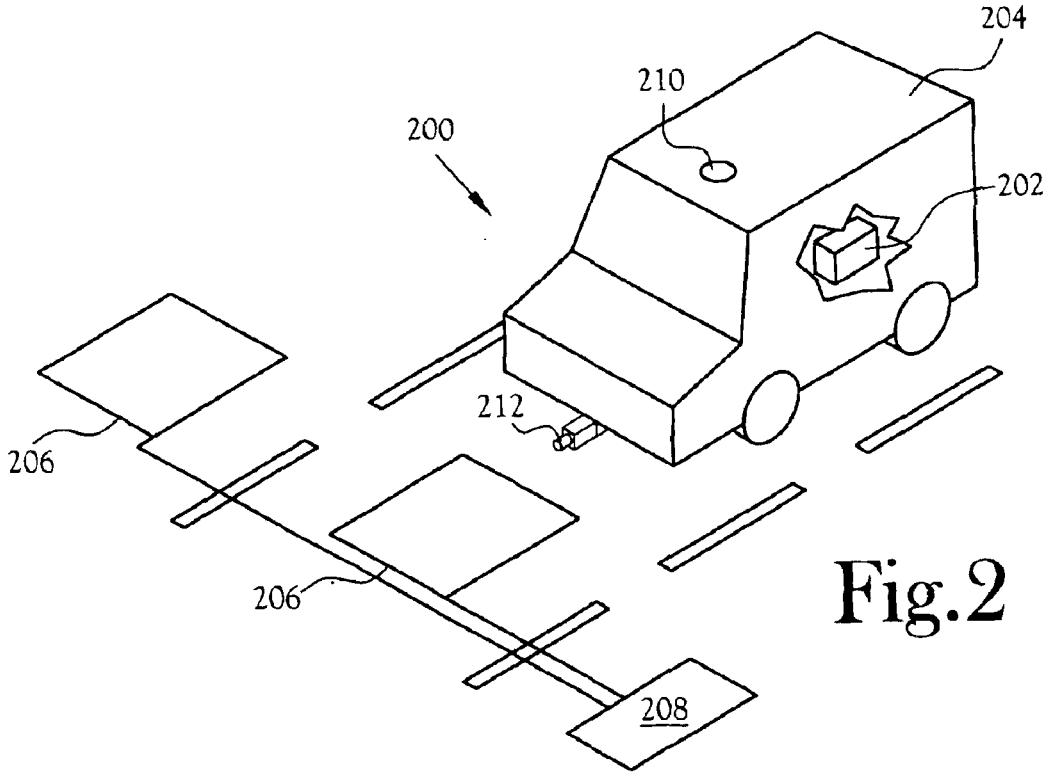
FIG. 2 illustrates a service vehicle employing a mobile inductive loop detector system according to the present invention.

FIG. 2 illustrates one embodiment of the present invention, a mobile inductive loop detector system 200 that includes a detector 202, which is transported by a service vehicle 204. When the service vehicle 204 encounters an installed traffic detector including a fixed-point sensor 206, the detector 202 measures one or more characteristics of a signal emitted by the fixed-point sensor 206. Those skilled in the art will recognize the type and number of characteristics recorded can and will vary depending upon the objectives of the surveillance and the type of fixed-point inductive loop detector encountered. The diagnostic information obtained from the detector 202 becomes further useful when measured in combination with a position determining system 210 carried by the service vehicle 204, for example, an inertial reference system or global positioning system. By using a position determining system 210, the precise location of fixed-point sensor 206 in the field is recorded along with the measured characteristics of the fixed-point sensor 206. Another useful addition to the mobile inductive loop detector system 200 is a camera 212 carried by the service vehicle 204. The camera 212 allows road conditions and lane markings to be monitored and recorded.

Some of the characteristics that are desirable to measure from the service vehicle 204 include the frequency response of the fixed-point sensor 206 in the presence of the service vehicle 204 with a known inductive signature, the noise level on the fixed-point sensor 206, the variability of the frequency response of the fixed-point sensor 206 due to environmental conditions (e.g., external capacitance and/or grounding due to rain), the interference between closely spaced fixed-point sensors 206 (e.g., crosstalk), the fixed-point sensor 206 footprint with respect to the traffic lane markings, and the wire-loop sensor geometry (e.g., multiple loop-heads wired together in series or parallel). Various techniques for measuring these characteristics are known to those skilled in the art and need no further description here.

For example, if the fixed-point sensor 206 is a frequency counting type detector then typical of the characteristics measured by the detector 202 are the frequency of the fixed-point sensor 206 and the frequency variation of the fixed-point sensor 206 in response to the presence of the service vehicle 204. By measuring a sequence of frequency response characteristics of the fixed-point sensor 206 that change as the service vehicle 204 moves in relation to the fixed-point sensor 206, an inductive signature of the service vehicle 204 is recorded.

It is known in the prior art to use the fixed-point sensor 206 to record a first inductive signature; however, the use of a mobile inductive loop detector 200 to measure a second inductive signature that is substantially similar to the first inductive signature measurable by the fixed-point sensor 206 offers advantages over the prior art. One advantage is that the service truck 204, having a known inductive signature profile, driven over any fixed-point sensor 206 records the frequency response of the fixed-point sensor 206 in the presence of the service vehicle 204. This allows many diagnostic parameters for the fixed-point sensor 206 to be measured without the necessity of having direct physical access to the remote vehicle detection circuitry 208 of the fixed-point sensor 206.

Figure 3:
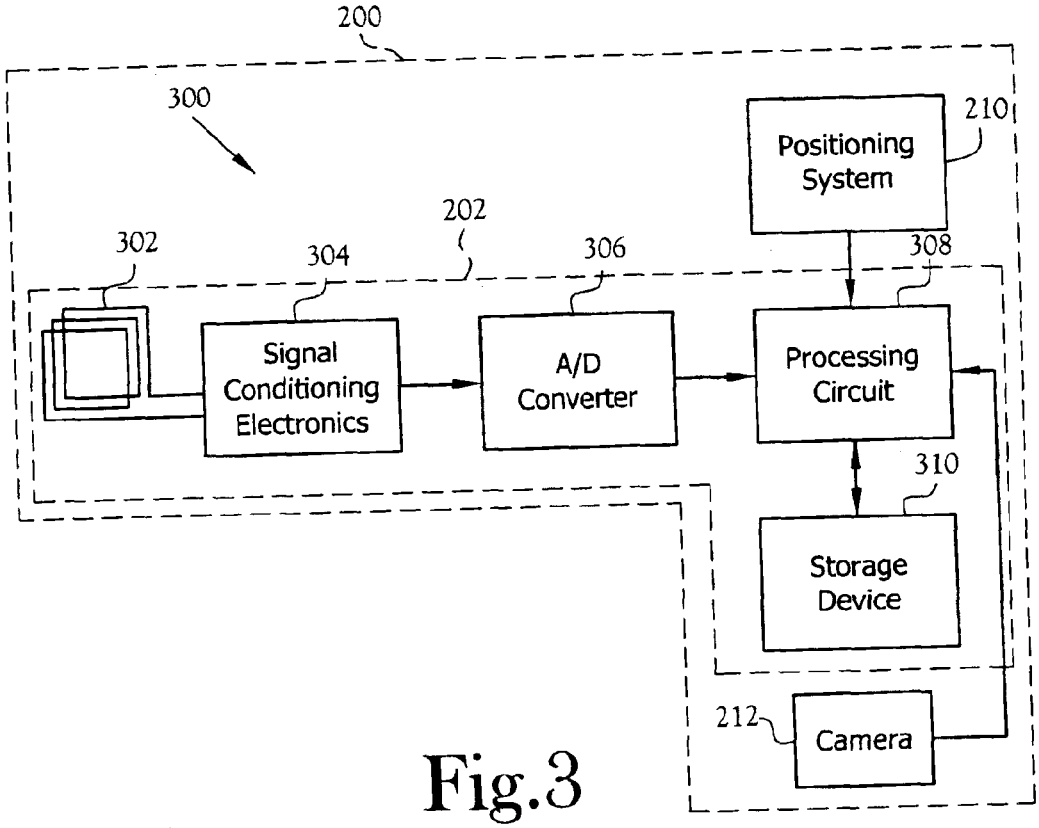
FIG. 3 is a schematic block diagram of a passive mobile inductive loop detector system of the present invention.

FIG. 3 illustrates a block diagram of a passive embodiment of the detector 202, or passive mobile inductive loop detector system 300. The detector 202 includes a pickup loop 302. The pickup loop 302 is a wire-loop sensor like the fixed-point sensor 206 that is typically mounted parallel to the roadway. The pick up loop 302 measures variations from an active signal emission of the fixed-point sensor 206. The output of the pickup loop 302 passes through signal conditioning electronics 304. An analog-to-digital converter (ADC) 306, typically of the fast sampling variety, converts the conditioned signal into a stream of digital samples. The digital samples are processed by a processing circuit 308. The processing circuit 308 also receives data from the positioning system 210. The data from the pickup loop 302 and the positioning system 210 are recorded in a storage device 310. The data can be stored in the raw form, the processed form, or any intermediate form. Where frequency is the only characteristic of interest, a zero-crossing detector (not shown) can be substituted for the fast-sampling ADC 306.

Figure 4:
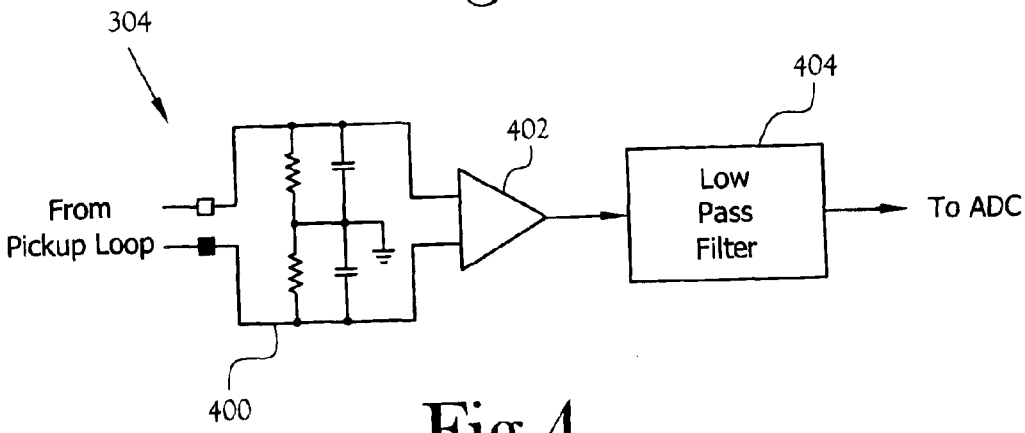
FIG. 4 is a schematic block diagram of one embodiment of the signal conditioning electronics for use in the mobile inductive loop detector system of the present invention.

FIG. 4 illustrates one embodiment of the signal conditioning electronics shown in FIG. 3 in greater detail. The signal conditioning electronics includes a differential LCR or Caduceus circuit 400, an instrumentation amplifier 402, and a filter circuit 404 removes unwanted frequencies from the amplified signal. In the illustrated embodiment, the filter circuit 404 is a low-pass filter. The differential conditioning circuit 400, 402 attenuates common mode noise while amplifying the differential signal from the pickup coil 302. The low-pass filter 404 filters the amplified signal prior to sampling by the ADC 306.

Figure 5:
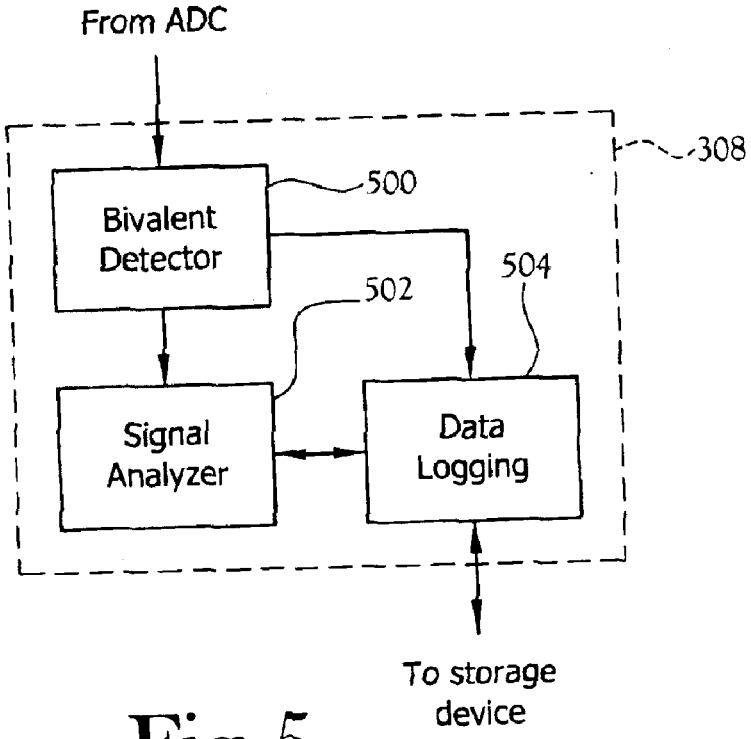
FIG. 5 is a schematic block diagram of one embodiment of the processing functions of the mobile inductive loop detector system of the present invention.
Figure 6A:
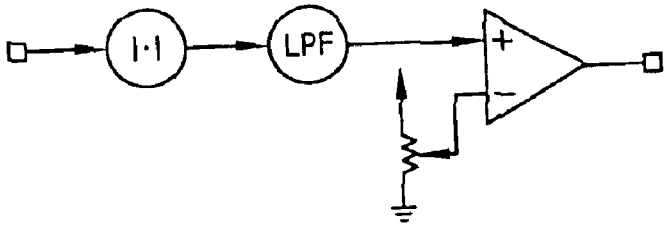
FIGS. 6*a* and 6*b* are schematics of one embodiment of a bivalent signal detector for use in the mobile inductive loop detector system of the present invention.
Figure 6B:
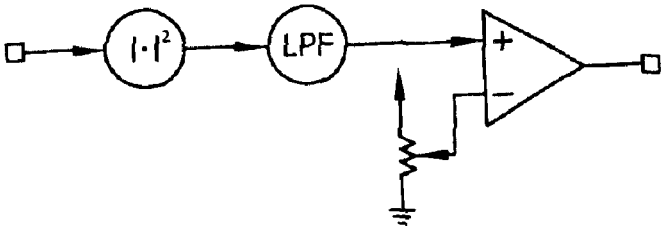

FIG. 5 illustrates one embodiment of the functions of the processing device 308 shown in FIG. 3 in greater detail. In the illustrated embodiment, the processing circuit 308 performs the functions of a bivalent signal detector 500 that indicates the presence or absence of a relatively strong external signal, an optional onboard signal analyzer 502, and an onboard data logging system 504. One embodiment of the bivalent signal detector 500 is schematically illustrated in FIG. 6. The bivalent signal detector 500 indicates the presence of a signal above a pre-set noise threshold. The bivalent signal detector 500 sums over a selected time period the absolute value of a fixed number of digital samples produced by the ADC 306 to produce a representation of the total energy of the pick-up signal. The total energy representation is compared to a threshold value, which is an empiracally determined level chosen to include most wanted signals and to exclude most unwanted signals from further analysis and/or storage. When the total energy exceeds the threshold value, further processing of the digital samples is indicated. Conversely, when the total energy does not exceed the threshold value, no further processing of the digital samples is indicated. Further processing of the digital samples includes the storage of the raw digital samples for later analysis, or an immediate analysis of the samples and storage of the raw samples and/or results. Using the onboard signal analyzer 502, one method for analyzing the samples uses an FFT (Fast Fourier Transform). The data logging system 504 cooperates with the storage device 310 to save the data for later analysis or review. One simple implementation of the processing circuit 308 and storage device 310 can be achieved using a computer. However, those skilled in the art will recognize the various other structures that can be used to implement the functions of the processing circuit 308 and the storage device 310 without departing from the scope and spirit of the present invention.

Review of the fixed-point loop sensor characteristics is made more useful when contemporaneous time and position information from the positioning system 210 is correlated with the electronic signal information. The addition of time and position information allows for a detailed mapping of the location of each fixed-point sensor surveyed. The locations where operating fixed-point sensors are not detected is also noted. Where problems are detected such as non-functioning detectors, improper frequency settings, and poor signal-to-noise ratios, remedial action may be planned based on the mobile inductive loop detector survey results.

Periodic, or continual, mobile inductive loop detector system 200 surveys are conducted to maintain the reliability of any operational vehicle detector system. By wirelessly measuring these parameters from a service vehicle 204 rather than by manually accessing the detector circuitry 208 directly, it is possible to safely and efficiently ground-truth a vehicle detector's performance without the necessity of involving local maintenance personnel. The service vehicle 204 associated with the mobile inductive loop detector system 200 is dedicated to the task of diagnosing loop detectors in the field. Alternatively, the mobile inductive loop detector system 200 is implemented in a portable package that is carried by any one of a number of fleet-type vehicles in which case the time, location, and measured parameters from inductive loops encountered in the field are logged for later retrieval and analysis, without the need for dedicated service vehicles 204. The concepts of the present invention may be applied to other types of field-deployed vehicle detection systems which emit active signals including radar-based, ultrasonic-based, laser-based, and infrared-strobe utilizing camera-based vehicle detector systems without departing from the spirit and scope of the present invention.

Using the mobile loop detector 200, the following are some, but not necessarily all, of the measurable parameters of a fixed-point sensor 206: (a) the presence of a fixed-point LCR circuit using either active or passive scanning; (b) the geographic location of loop-head (e.g., absolute latitude, longitude, and altitude); (c) the dimensions and orientation of loop-head with respect to marked lane boundaries; (d) the LCR circuit parameters, e.g., inductance, capacitance, resistance, alpha parameter, omega parameter, Q-Factor, and loop head/lead-wire ratio; (e) the base operating frequency; (f) the frequency variance; (g) the frequency response of the inductive loop detector to a known probe vehicle (and/or wide-band active excitation); (h) the signal-to-noise ratio of an inductive loop detector; (i) the signal-to-noise degradation due to rain; (j) the crosstalk from other nearby loops; and (k) the accuracy limit for speed, volume, occupancy, and/or inductive length measurements. Exemplary methods for determining these parameters are described hereafter.

Figure 30:
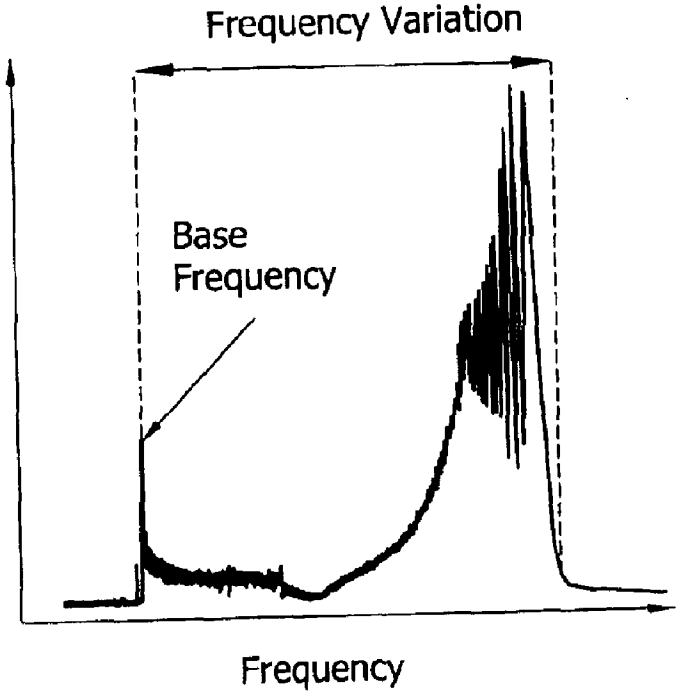
FIG. 30 illustrates the frequency-domain response of a single-channel frequency counting detector as seen by a mobile inductive loop diagnostic detector system.
Figure 29:
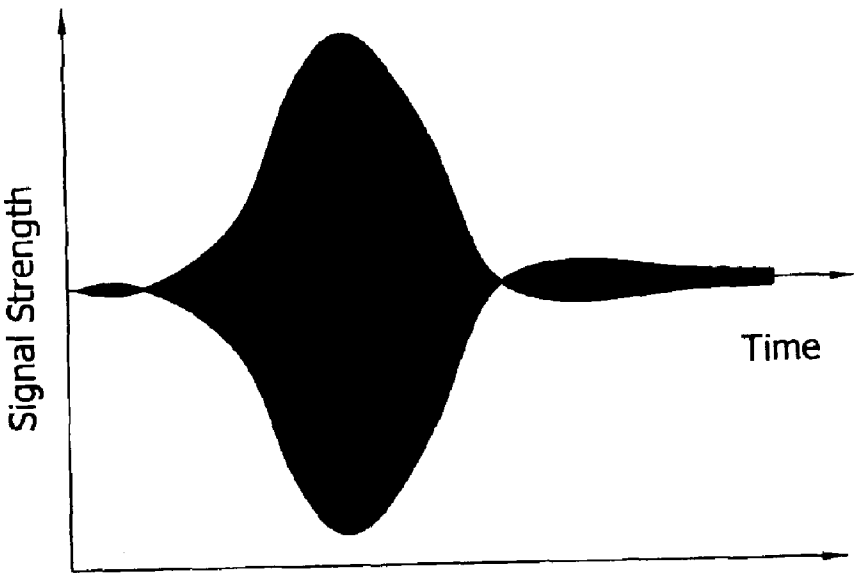
FIG. 29 illustrates the time-domain response of a single-channel frequency counting detector as seen by a mobile inductive loop diagnostic detector system.
Figure 32:
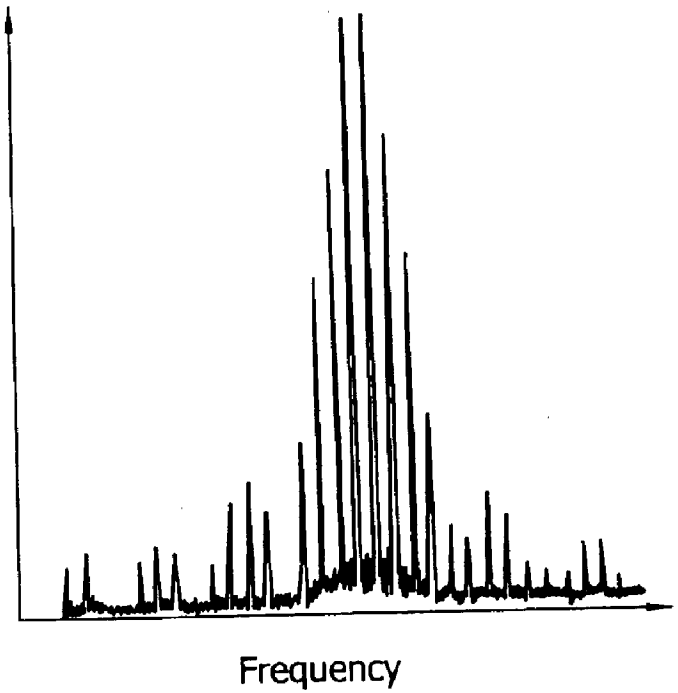
FIG. 32 illustrates the frequency-domain response of a time-domain response of a time-multiplexed fixed frequency detector as seen by a mobile inductive loop diagnostic detector system.
Figure 31:
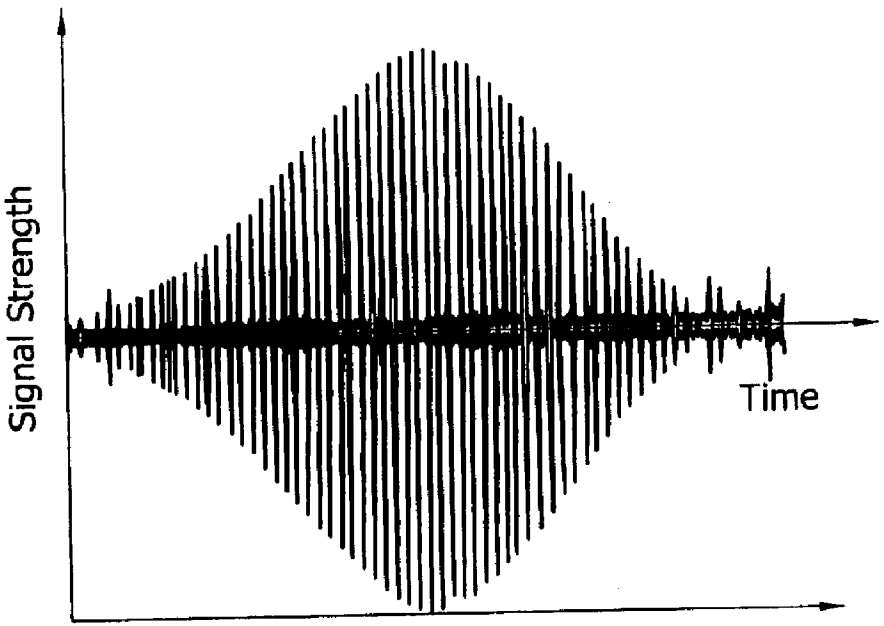
FIG. 31 illustrates the time-domain response of a time-multiplexed fixed frequency detector as seen by a mobile inductive loop diagnostic detector system.
Figure 34:
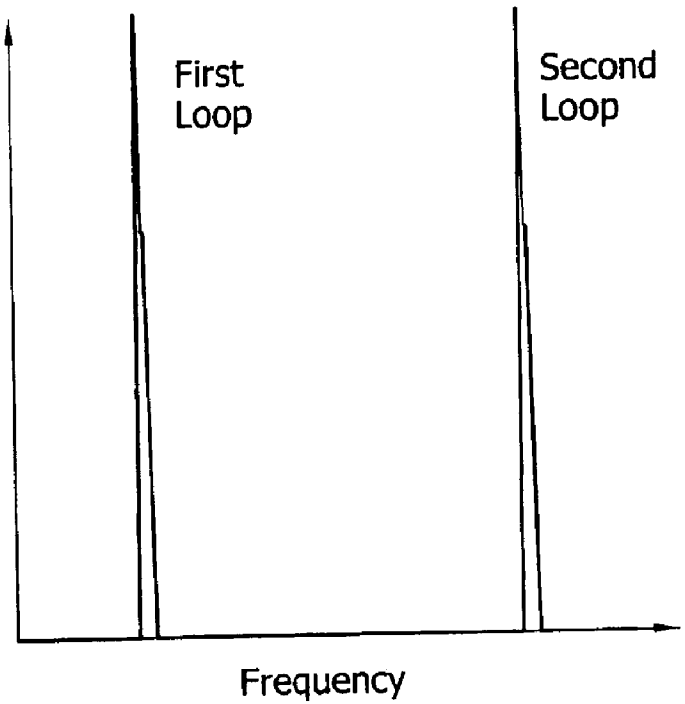
FIG. 34 illustrates the frequency-domain response of a two-channel fixed frequency detector as seen by a mobile inductive loop diagnostic detector system.
Figure 33:
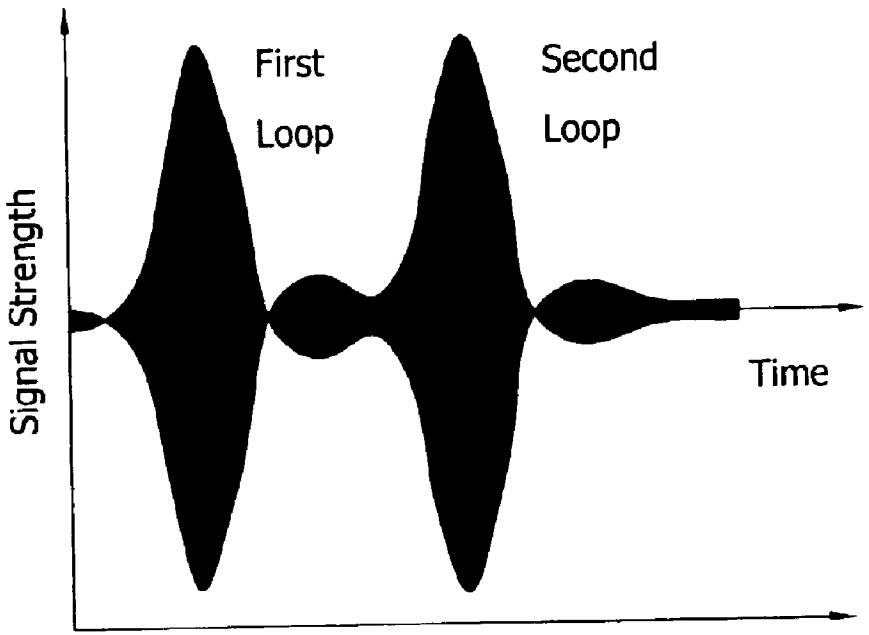
FIG. 33 illustrates the time-domain response of a two-channel fixed frequency detector as seen by a mobile inductive loop diagnostic detector system.

After identifying an interesting signal, the appearance of a strong frequency component in the FFT provides a location to look for the located detector's driving signal. The shape of the signal will identify the type of the detector. Some typical detector classifications are the single-channel frequency counting detector, the multi-channel time-multiplexed frequency counting detector, and the fixed-frequency detector. A frequency counting detector contains an oscillator which oscillates at the resonant frequency of an LCR circuit where the main inductance is from the sensor loop. When a vehicle passes over the sensor loop and changes its inductance, the detector's oscillator tracks the resulting change in the resonant frequency. A single-channel frequency counting detector, whose time domain response is illustrated in FIG. 29, has a frequency spectrum, as shown in FIG. 30, that sweeps over some frequency range, starting from a base frequency when no vehicle is present and varying up to some maximum frequency depending on the inductive signature of the vehicle crossing over the loop at the time. FIG. 29 slows a time domain plot of a single-channel frequency counting detector as a service vehicle drives over the detector. FIG. 30 shows the FFT of the time plot in FIG. 29 depicting the detector's base operating frequency and frequency variance as the service vehicle passes over the roadway detector. The time-multiplexed detector, whose time domain response is illustrated in FIG. 31, is an attempt to combat crosstalk between multiple detection channels on one detector board. The detector periodically gates each oscillator such that only one loop is energized at any one time. The resulting frequency occupancy is larger than the non-multiplexed case because the gated time domain signal results in a series of spikes in the frequency domain, as shown in FIG. 32, whose distance is a function of the gating frequency. FIG. 33 shows a time plot of a time-multiplexed frequency counting detector as a service vehicle drives over the detector. Notice that the signal is inhibited periodically. FIG. 34 is the FFT of the time plot in FIG. 33 depicting the series of spikes produced by the time-multiplexing method. A fixed-frequency detector with a time domain response, as shown in FIG. 33, actively drives sensor loops at one frequency. The result is that they have one localized frequency spike, as illustrated in FIG. 34, making them easy to separate and identify. FIG. 31 shows a time domain plot of two fixed-frequency loop detectors arranged as a speed trap as a sensor vehicle drives over the speed trap. FIG. 32 shows the FFT of the time plot in FIG. 31 depicting the narrow bandwidths of each loop. Since each loop in the speed trap is driven at different frequencies to avoid crosstalk, each loop shows up as a separate spike in the Frequency domain.

The geographical location of roadway detector loops 206 are found with conventional position determining equipment 210. Two types of position determining equipment 210 are the Global Positioning System (GPS) and an inertial navigation system (INS). It is important to calibrate the location of the positioning determining equipment 210 with respect to the location of the pickup antenna(s) 302 installed in the service vehicle 204. It is also important that the position determining equipment 210 is rigid with respect to the pickup antenna(s) 302.

The dimension of the roadway detector loop 206 in the direction of travel is related to the shape of the measured time-domain signal amplitude as well as the dimensions, geometry, and height of the pickup antenna 302. To actually convert the measured time domain signals (FIGS. 29, 31, and 33) to length dimensions requires the contemporaneous data from the position determining equipment and a time reference.

Identifying crosstalking roadway loop detectors 100, 103, 104 involves looking at the frequency spectrums (FIGS. 30, 32, and 34) of individual detectors and seeing if they overlap with, or are too close to any neighboring detectors. This step is typically performed off-line after all of the data is acquired and all of the loops of interest and their positions are identified. When all of the loops are identified, loops positions are clustered to identify nearby loops and their individual spectrums compared to identify crosstalk. Alternatively, a search for weaker overlapping signals in a single detector's spectrum is performed to identify nearby detectors in real-time. Crosstalk measurements are also useful in determining the performance of a roadway loop detector 206. How a roadway loop detector 206 handles crosstalk depends on its manufacture. As a result, a detector can always perform worse than predicted.

Detecting roadway loops that are wired in parallel or series is similar to detecting crosstalk. It involves analyzing the recorded data off-line by clustering the roadway loop detector positions and comparing their signals to see if nearby loops are emitting similar signals.

Measuring the signal-to-noise ratio (SNR) of a detector is also similar to measuring crosstalk except that measuring SNR involves looking at how unclassified signals are interfering with a loop detector. Two examples of interfering signals are radio transmitters and power lines. Even though power line frequencies are largely separated from the very low frequency (VLF) roadway loop detector frequencies and are usually common-mode on the lead lines, roadway loop detectors 206 are known to have difficulty dealing with power line interference. Again, like in the crosstalk situation it is not always possible to know how an unknown detector will handle a particular noisy situation. Nonetheless, it is possible to determine the difficulty level of the detector in the situation and formulate a mitigating strategy.

Obtaining a vehicle signature from a mobile passive diagnostic data acquisition involves measuring the frequency or phase variation of the detector's driving signal as the service vehicle 204 drives over an operating roadway loop. Getting the frequency or phase variation involves demodulating the measured signal using well known frequency modulation (FM) communication techniques. Because frequency and phase variation is independent to the signal strength, the vehicle signature is separable from the signal strength change caused by the pickup antenna 302 approaching and leaving the vicinity of the roadway loop detector 206.

Weather equipment is mounted on the service vehicle 204 so that the contributions of the weather on the roadway loop detectors 206 can be determined. Alternatively, the current weather report is recorded along with the data.

Figure 7:
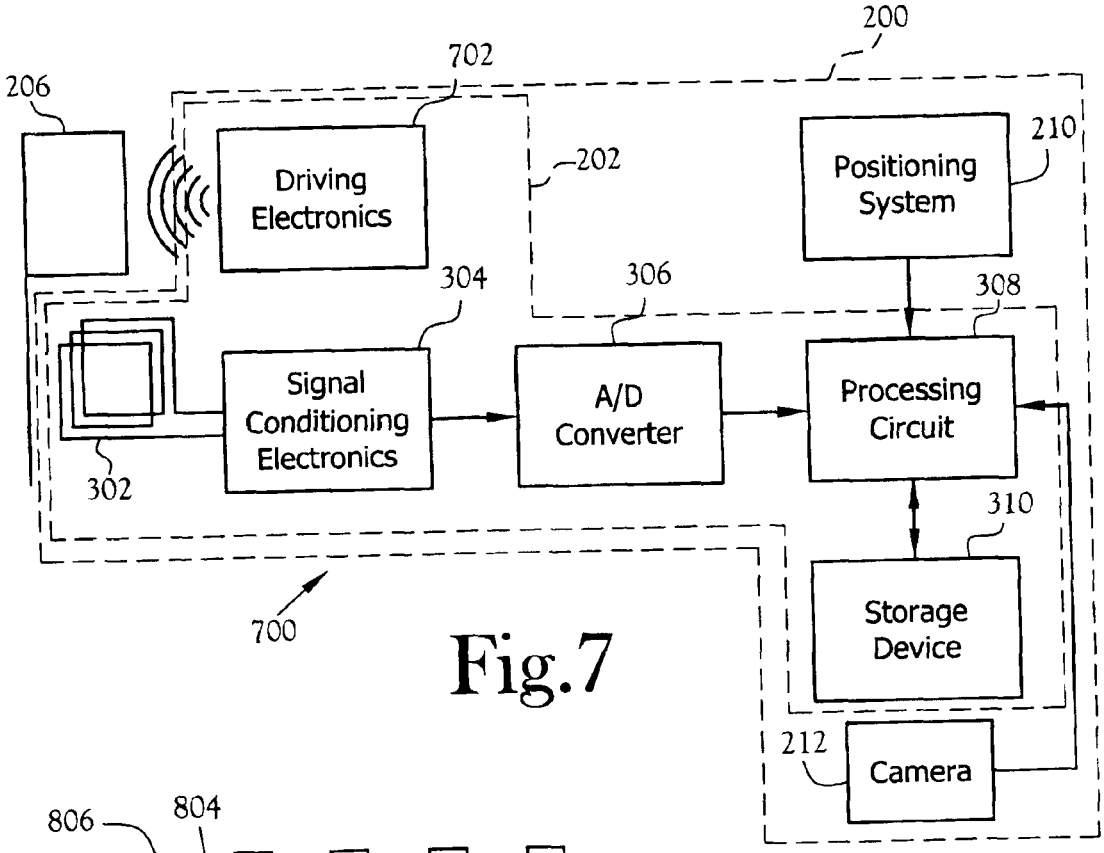
FIG. 7 is a block diagram of an active mobile inductive loop detector system.

The passive mobile inductive loop detector system 300 requires an active signal emission from a fixed-point wire-loop detector. However, in an alternate embodiment illustrated in FIG. 7, an active mobile inductive loop detector system 700 is able to detect the presence and electrical characteristics of a fixed-point sensor 206 that is present but not powered up. The active mobile inductive loop detector system 700 adds a driving electronics circuit 702 to the basic structure of the passive mobile inductive loop detector system 300. The driving electronics circuit 702 emits a driving signal from the mobile service vehicle 204. The driving signal is a periodic or pulsed signal that energizes an inactive fixed-point inductive senor 206. Following excitation, the inactive fixed-point inductive senor 206 is detected and characterized using substantially the same methods as for the passive mobile inductive loop detector system 300. The active mobile inductive loop detector system 700 of the present invention is useful for detecting the existence and characterizing the performance of inactive fixed-point inductive loop sensors from a mobile service vehicle 204.

Figure 8:
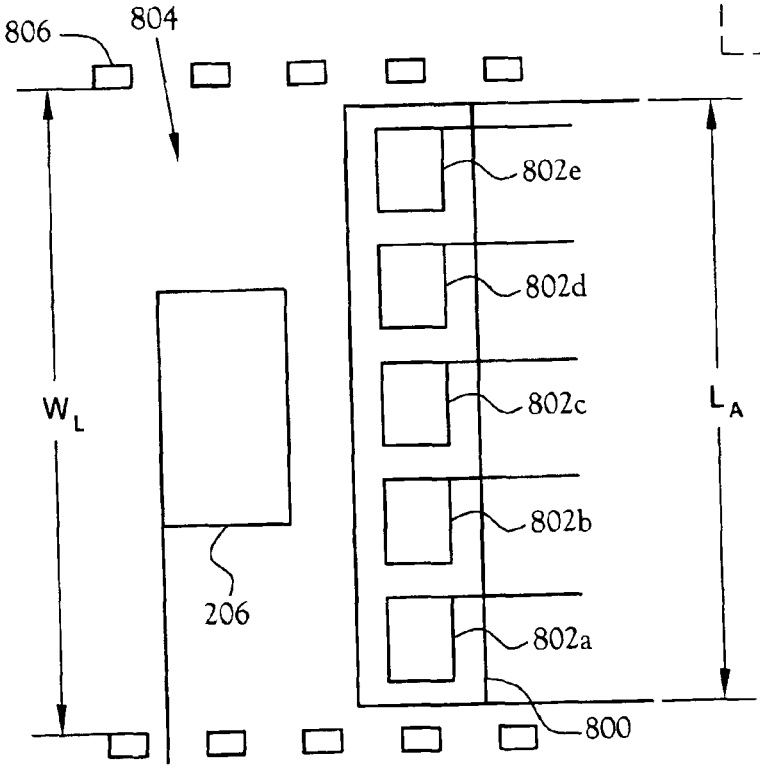
FIG. 8 is an illustration representing an array of pickup loops adapted to locate the relative position of an inductive sensor installation within a traffic lane.

FIG. 8 illustrates a pickup loop array 800 adapted to wirelessly measure the loop geometry of a fixed-point sensor 206. Common fixed-point sensors 206 of the prior-art are typically positioned in the center of a traffic lane 804 when they are first installed. However, over time it is common for roadways to be re-paved and for lane markings 806 to be re-painted. This sometimes results in the center of the traffic lane 804 shifting relative to the embedded fixed-point sensor 206. It is often difficult or impossible to find the position of the fixed-point sensor 206 from visual cues. Additionally, it is difficult to measure the lateral dimension of a roadway loop detector 206 from a single pickup antenna. In the illustrated embodiment of the present invention, a plurality of wire-loop pickup coils 802*a–e* are organized in a linear array 800. The length of the array $L_A$ is selected to encompass an area of interest, typically the width of a single traffic lane $W_L$. The array is adapted to be carried by a service vehicle.

When the array 800 detects the presence of a fixed-point sensor 206, the geographic position of the pickup coil array 800 is recorded. Because the service vehicle is in motion relative to the fixed-point sensor 206 and because the each element 802*a–e* of the linear array 800 of pickup coils senses a different zone of detection that is laterally offset across the width $W_L$ of the traffic lane 804 with respect to the other elements 802*a–e* of the linear pickup coil array 800, sequential samples from each detector array element 802*a–e* combine to produce a dot-matrix map of the fixed-point sensor's loop geometry, which is also mapped with respect to the physical geometry of the traffic lane 804. In one embodiment of the present invention, a dot-matrix representation of the fixed-point sensor 206 is superimposed over a map of the physical roadway 804 including lane boundary markings 806. Those skilled in the art will recognize the various alternate methods of representing or mapping the geometries of the measured fixed-point sensor 206 and roadway 804 that fall within the spirit and scope of the present invention.

Alternatively, the rigidly-mounted camera 212 on the service vehicle 204, is pointed at the roadway, and calibrated with respect to the position determining equipment 210 and the pickup antenna 302. The camera images can then be recorded and analyzed in order to determine where the lane markings 806 as well as the loop saw cuts are with respect to the service vehicle 204. The same images could be analyzed to also detect potholes and eroded or missing lane markings.

Another application for the mobile loop detector system 200 is fixed-point detector calibration. When the mobile service vehicle 204 is in close proximity to a wire-loop sensor 206 associated with a traffic detector, the controller of the traffic detector and the mobile service vehicle 204 communicate digital information with each other. One way for the detector 208 to communicate with the service vehicle 204 involves modulating the driving signal on the loop 206 which is then returned by the pickup coil 302 in the service vehicle 204. The service vehicle 204 can similarly transmit data to the roadway detector 208 by modulating a driving signal on the pickup coil 302 using the driving electronics 702. Typically, the controller communicates identification information (e.g., serial number) to the mobile service vehicle 204 and the mobile service vehicle sends inductive signature calibration coefficients, based on its own inductive signature, to the controller. The controller responds by adjusting a digital signal processor or other processing device to adjust the output based upon the characteristics of the particular sensor configuration.

Figure 28:
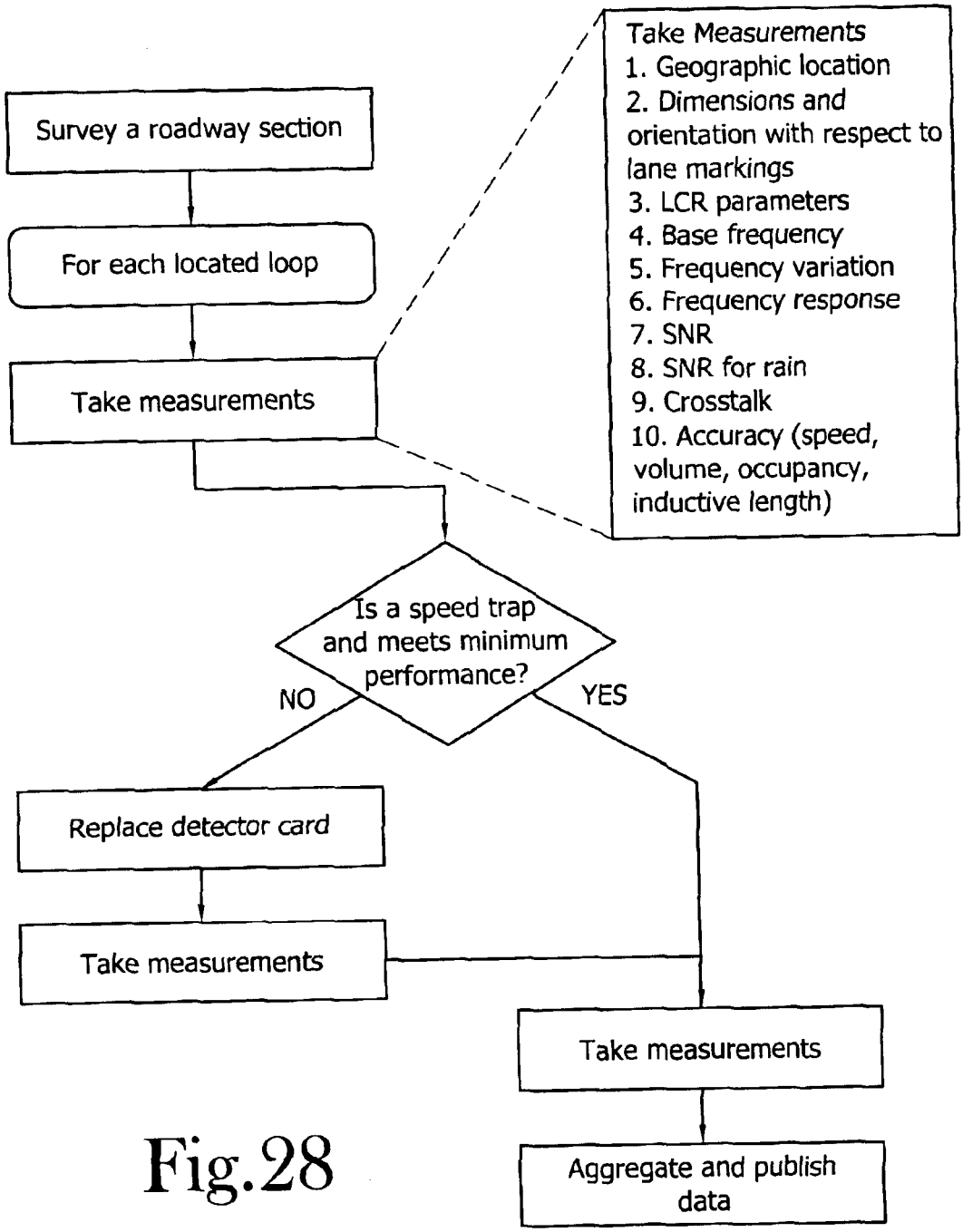
FIG. 28 illustrates a flow diagram of a method for performing an exhaustive freeway loop detector survey.

FIG. 28 illustrates a method for performing an exhaustive freeway loop detector survey. The method generally includes the steps of (a) locating all functioning freeway loops including functional loop/detector circuits that are powered-down; (b) For each functioning or functionable loop circuit located: (1) Report the precise geographic coordinates of the loop-head (latitude, longitude, and altitude) to within 1-meter or better (subject to availability to civilians of high-precision GPS signals); (2) Map the approximate dimensions and orientation of each loop-head with respect to the current lane markings; (3) Measure the LCR circuit parameters: inductance, capacitance, resistance, alpha parameter, omega parameter, Q-Factor, loop-head/lead-wire ratio; (4) Measure the base operating frequency of the loop detector; (5) Measure the frequency variance of the loop detector; (6) Measure the frequency-response of the inductive loop detector to a known probe vehicle (and/or wide-band active excitation); (7) Measure the signal-to-noise ratio of inductive loop detector; (8) Measure the signal-to-noise degradation due to rain as weather permits (requires separate observations during both fair weather and inclement weather conditions—each observation is billed separately); (9) Measure the actual crosstalk from other nearby loop detector circuits; (10) Estimate the accuracy limit of the loop detector for: speed, volume, occupancy, and inductive length measurements; (c) For each loop detector circuit which does not meet a minimum field performance standard: (1) Locate the field cabinet and replace the existing loop detector card with an advanced detector card; (2) Remeasure loop detector performance parameters (a) For each loop found to be now in compliance with the minimum field performance standards: the new card is left in place, and a detailed report is provided detailing the before and after test results; (b) For each loop found to still not be in compliance with the minimum field performance standard, a detailed report is provided; (d) For each loop detector site containing only one loop per lane, and therefore not reporting speed and occupancy information: (1) Locate the field cabinet and replace the existing loop detector card with an advanced detector capable of speed determination from single-loop sensor configurations; (2) Remeasure the loop detector performance parameters; (a) For each loop found to be now in compliance with the minimum field performance standard (including the continuous reporting of speed and occupancy information to the traffic controller), a detailed report will be provided; (b) For each loop found to still not be in compliance with the minimum field performance standard, a detailed report will be provided; (e) All data collected is maintained online via the Internet with password access to authorized individuals including: (1) Freeway maps of each loop measured; (2) Measured loop geometry diagrams with respect to lane markings present at the time the loop was observed; and (3) Electrical and field performance measurements made.

B. Enhanced Inductive Target

Figure 9:
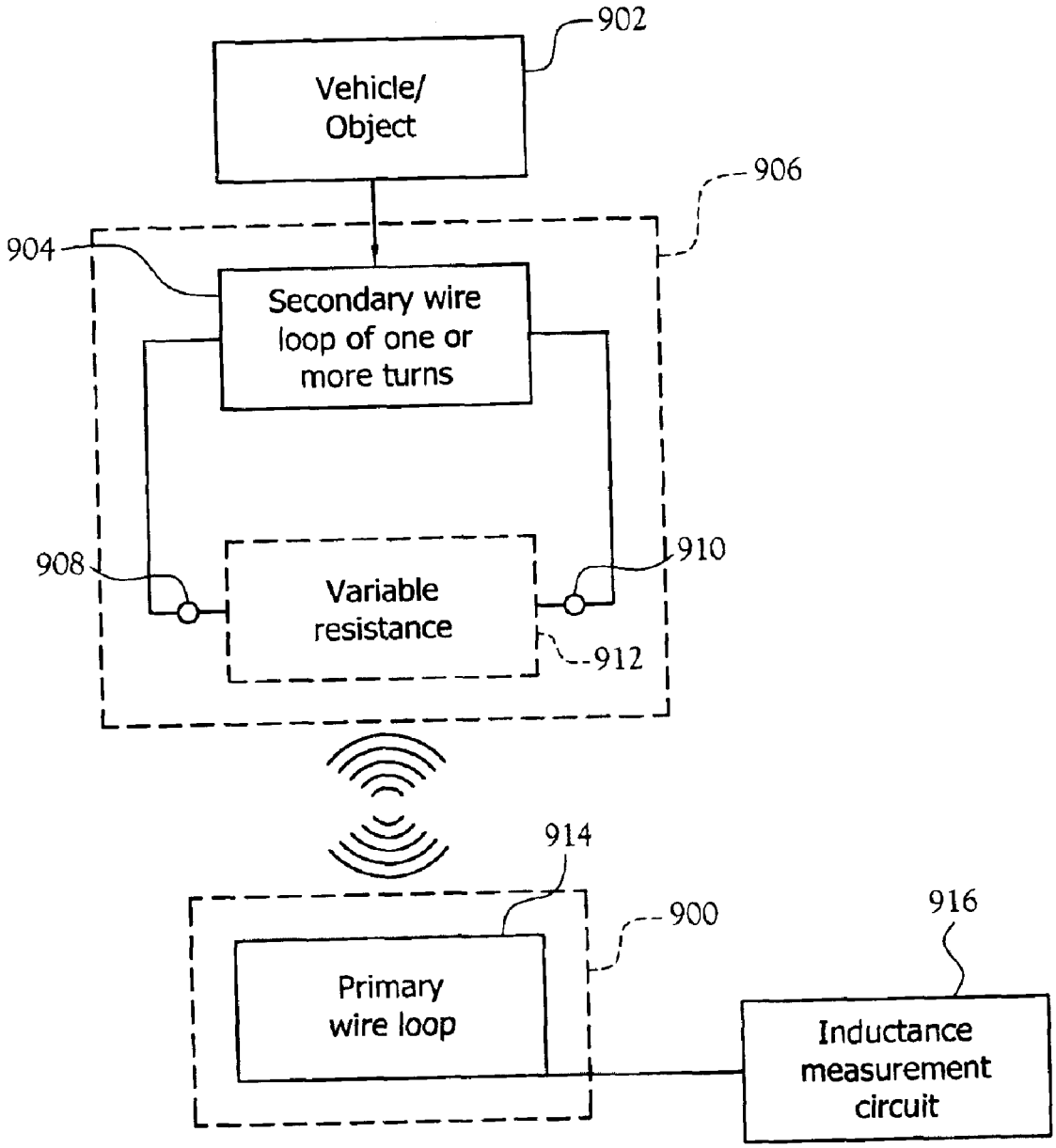
FIG. 9 is a block diagram of an enhanced inductive target.

An inductive vehicle detector 900 measures changes in the location of nearby metal vehicles/objects 902. It is sometimes desirable to enhance the signal measured by the detector 900 without necessarily making significant changes to the size, mass, or physical construction of the object 902 being detected. FIG. 9 illustrates the use of a secondary wire loop 904 to form an enhanced inductive target 906. The enhanced inductive target 906 is carried by the object 902 to be detected by the inductive vehicle detector 900. The secondary wire loop 904 may have one or more turns of wire. In its simplest embodiment, two terminals 908, 910 of the secondary wire loop 904 are connected together to form an infinite current loop. Optionally, the two terminals 908, 910 can be connected by a variable resistance 912 that is modulated to selectively vary the enhancement of the inductive target. One example of an appropriate variable resistance 912 device is a transistor. Those skilled in the art will recognize other means of varying and/or controlling the degree of enhancement of the enhanced inductive target 906 that fall within the spirit and scope of the present invention. For example, the windings of the secondary wire loop 904 of the present invention may be wound around a metallic core.

Figure 10:
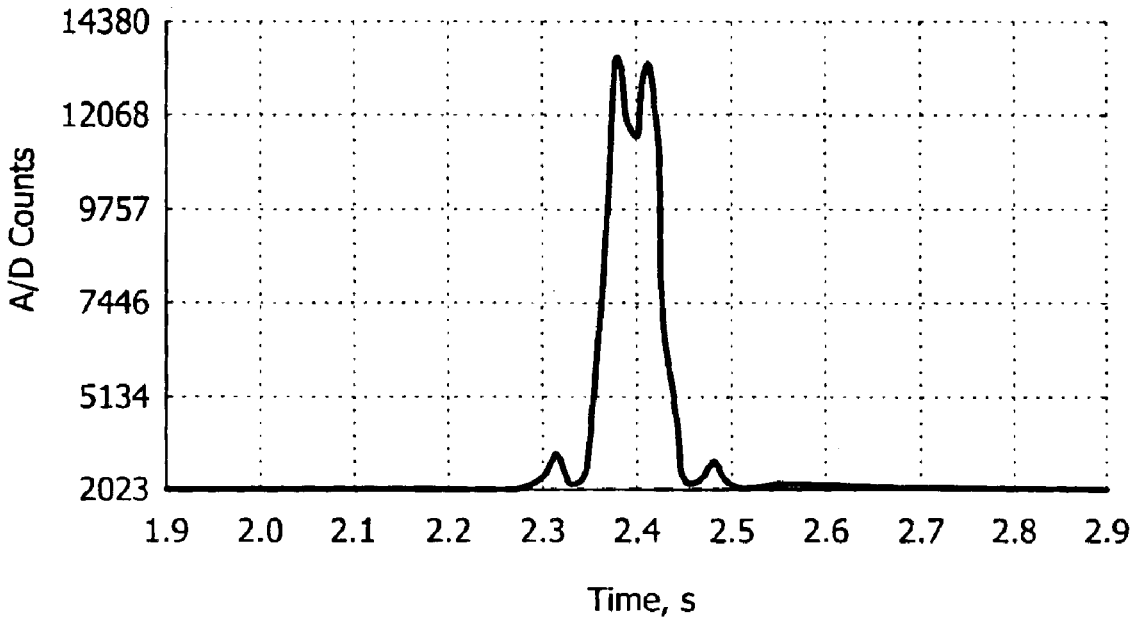
FIG. 10 shows an inductive signature obtained with one embodiment of the enhanced inductive target of the present invention.

The inductive vehicle detector 900 generally includes a primary wire loop 914 with an alternating current flowing therein in communication with an inductance measurement circuit 916. When the enhanced inductive target 906 is brought near to the primary wire loop 914 of the inductive vehicle detector 900, an opposing current is induced into the secondary wire loop 904 through a process of mutual induction. The effect of this mutual inductance is detectable by the inductance measurement circuit 916 driving the primary wire loop 914. The construction and placement of the secondary wire loop 904 determines the relative strength of the enhanced signal detected by the inductance measurement circuit 916. In general, increasing the area of the secondary wire loop 904, increasing the wire gauge of the secondary wire loop 904, and decreasing the resistance of the wire forming the secondary wire loop 904 all tend to increase the degree of signal enhancement attributable to the enhanced inductive target 906 of the present invention. The enhanced inductive target 906 operates most efficiently, when oriented parallel to the primary wire loop 914. FIG. 10 illustrates an inductive signature measured from an enhanced inductive target 906 using a single turn of wire.

Figure 11:
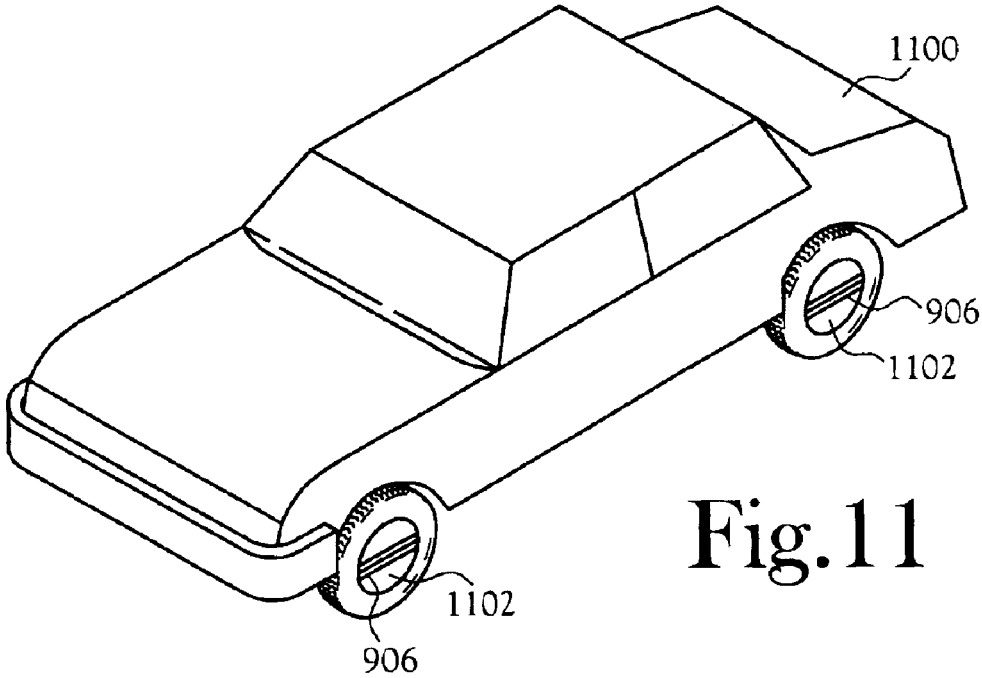
FIG. 11 illustrates a vehicle equipped with enhanced inductive targets carried by each wheel.
Figure 12:
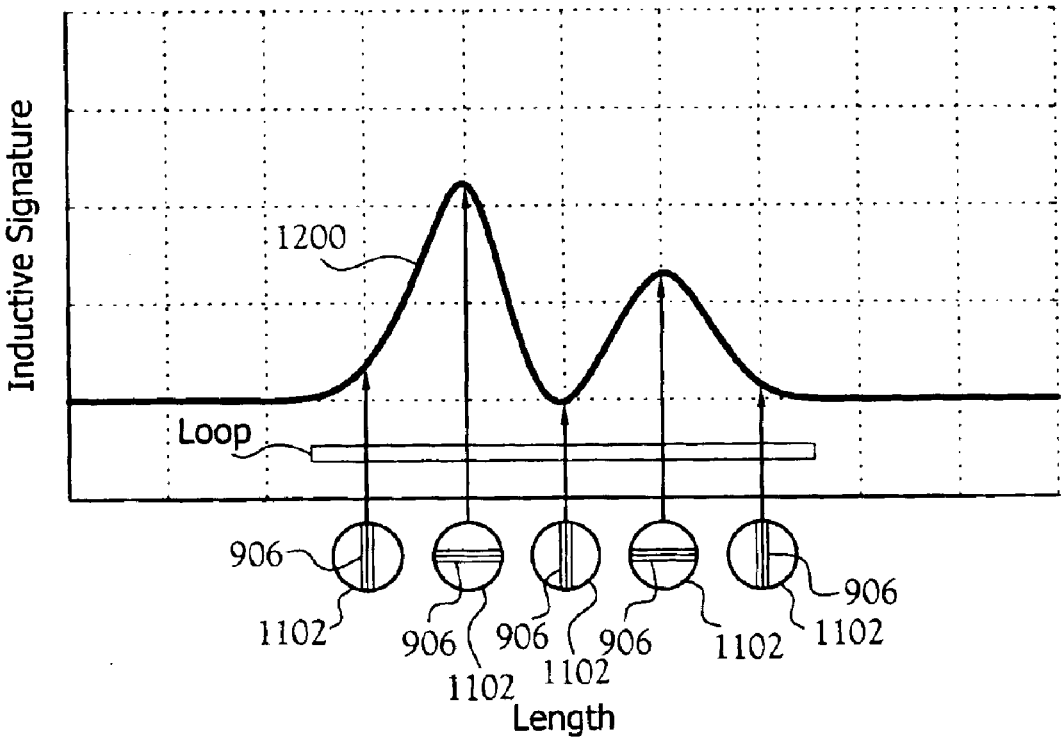
FIG. 12 is a representative inductive signature from a wheel-mounted enhanced inductive target.

One use for an enhanced inductive target 906 is the marking of vehicles and pedestrians that are otherwise hard to detect using inductive vehicle detectors (e.g., bicycles, snow plows, pedestrians, etc.). FIGS. 11 and 12 illustrate another use of the enhanced inductive target 906 of the present invention, which is in more uniquely identifying certain vehicles to a vehicle monitoring system. Generally, one or more enhanced inductive targets 906 are attached to the vehicle. FIG. 11 shows a vehicle 1100 with four enhanced inductive targets 906. The enhanced inductive target 906 is placed around the diameter of the wheel rims 1102 or embedded within the tires of a subject vehicle. Those skilled in the art will recognize that the enhanced inductive targets can be carried in other locations without departing from the scope and spirit of the present invention. Further, it will be recognized by those skilled in the art that more than one enhanced inductive target may be placed within any of the wheels and/or tires or at any other location on the vehicle.

When passing a suitably configured primary wire loop vehicle detector, the enhanced inductive targets 906 carried by a subject vehicle are detected. FIG. 12 illustrates one inductive signature 1200 produced by the inductive vehicle detector in response to an enhanced inductive target 906 carried on the wheel 1102 of the vehicle 1100. For example, a wheel 1102 wrapped with an enhanced inductive target 906, as shown in FIG. 11, produces an inductive signature like the one shown in FIG. 12. As the wheel 1102 turns through the magnetic field generated by the primary wire-loop vehicle detector, the peaks of the signature are when the enhanced inductive target is parallel to the primary wire-loop vehicle detector. These peaks show the number of revolutions the wheel 1102 has in this magnetic field. Many vehicle characteristics can be determined from this signature using a few known parameters. Vehicle speed, acceleration, wheel circumference are a few of the vehicle characteristics that can be obtained using an enhanced inductive target on vehicle wheels.

Figure 13:
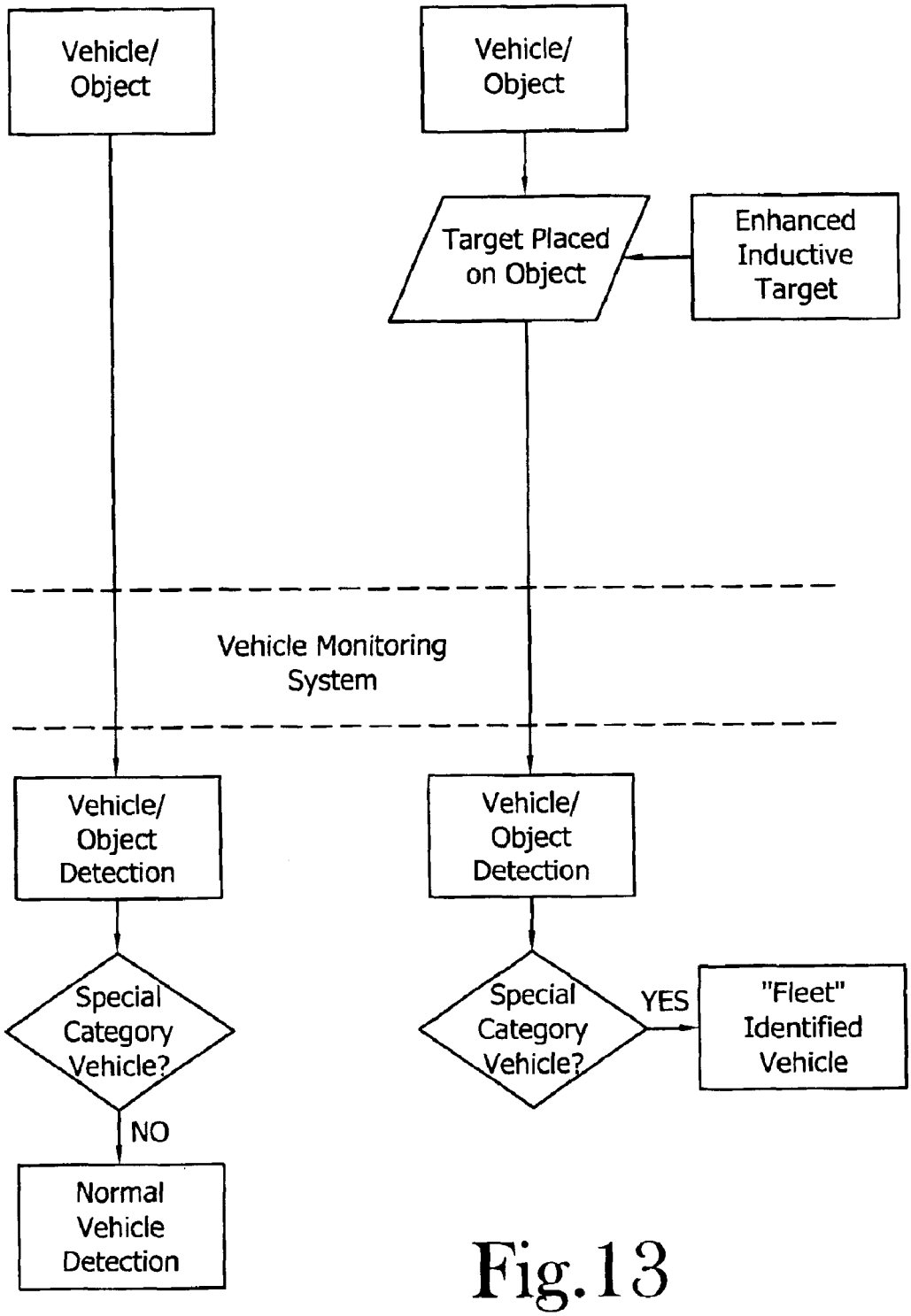
FIG. 13 is a flow chart showing how an enhanced inductive target is used to identify a special category vehicle.
Figure 14:
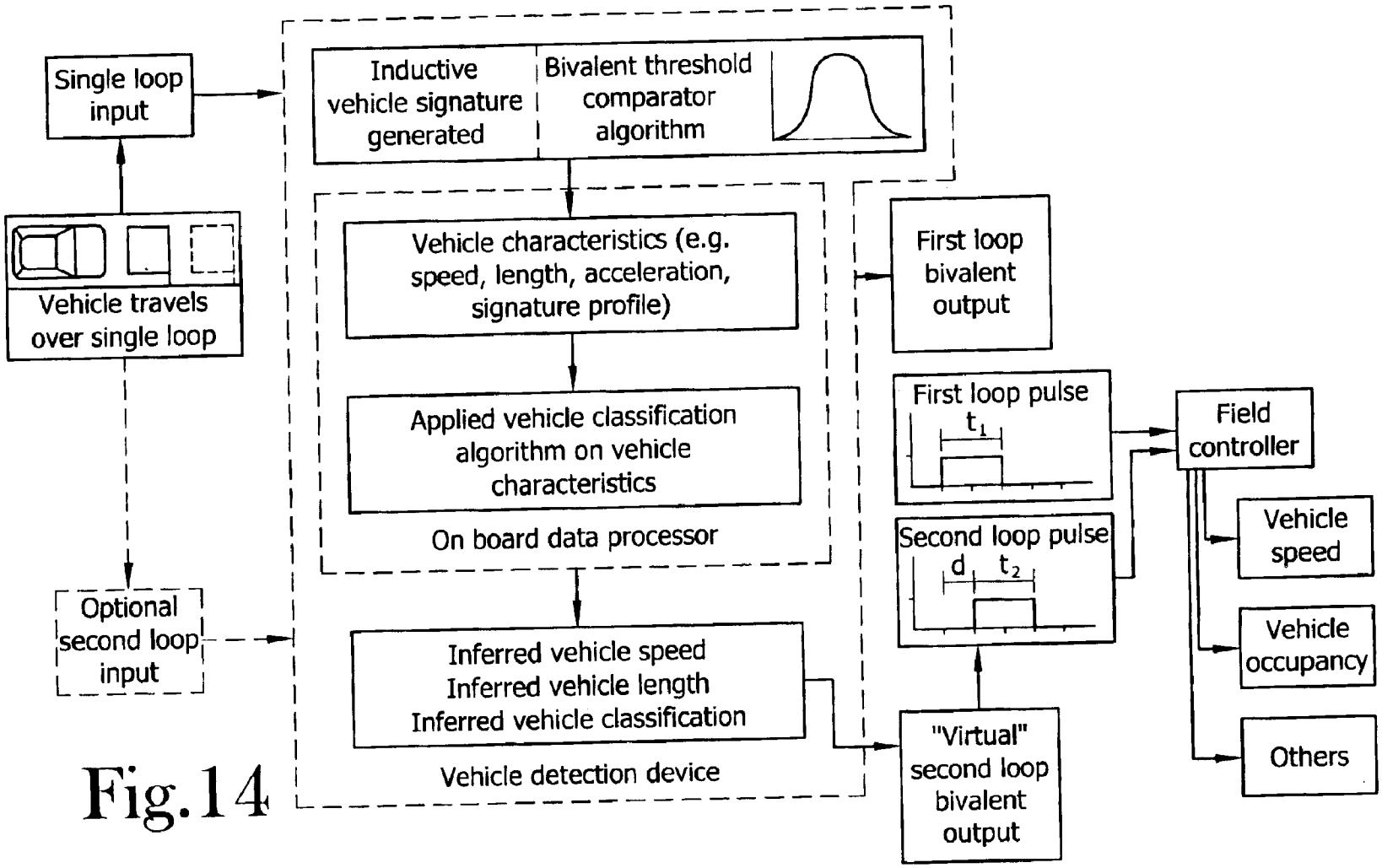
FIG. 14 schematically charts the method of single wire-loop speed estimation.
Figure 15:
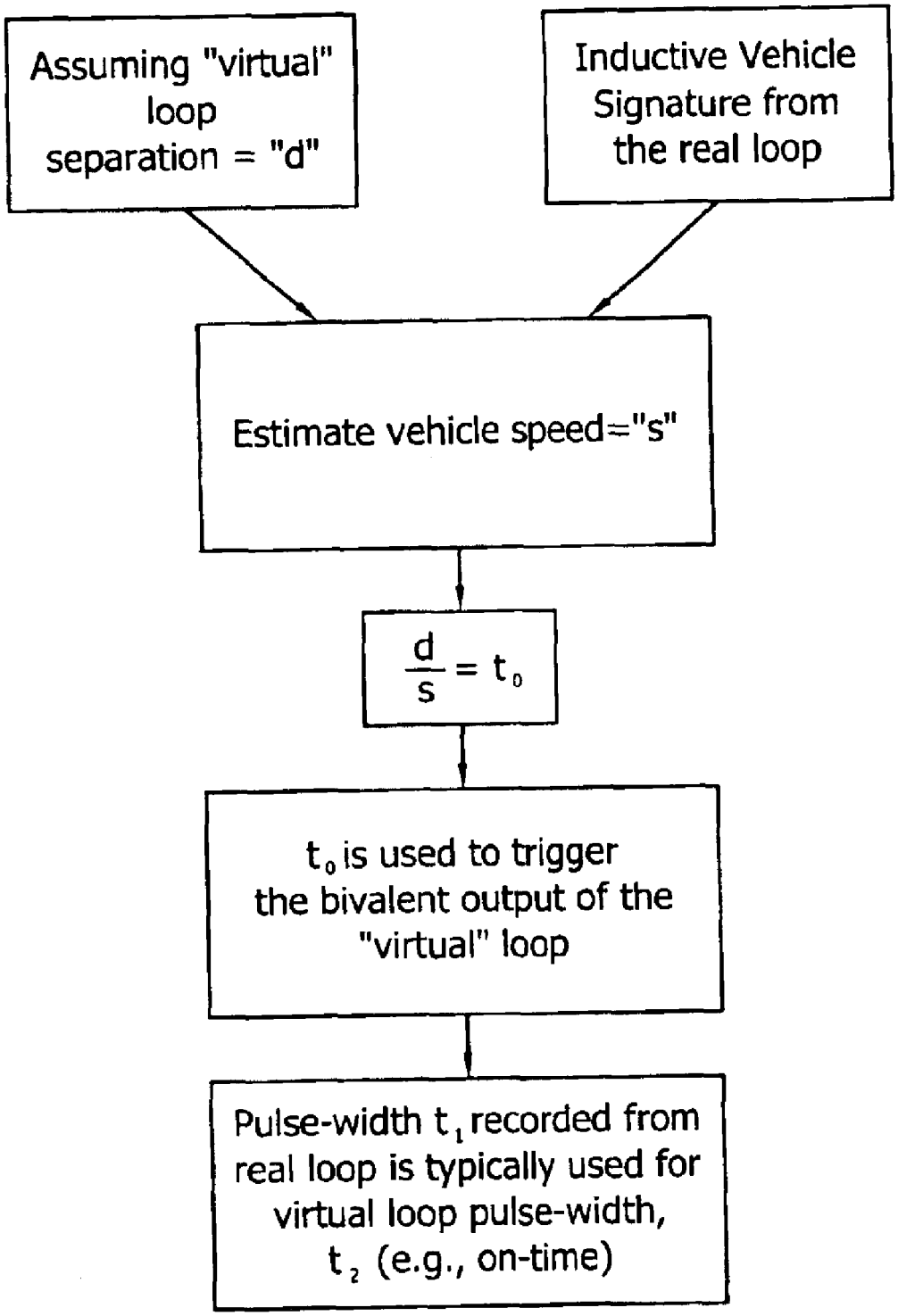
FIG. 15 charts the on-board processes for single wire-loop speed estimation and communication.
Figure 16:
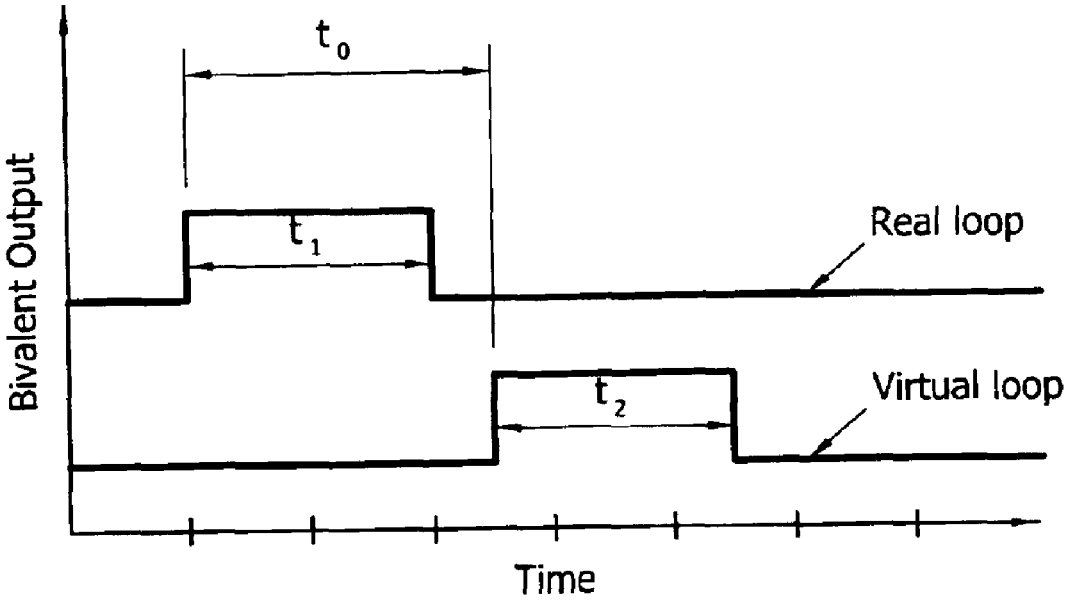
FIG. 16 illustrates the real and synthesized bivalent outputs for the single wire-loop speed estimation and communication system.
Figure 17:
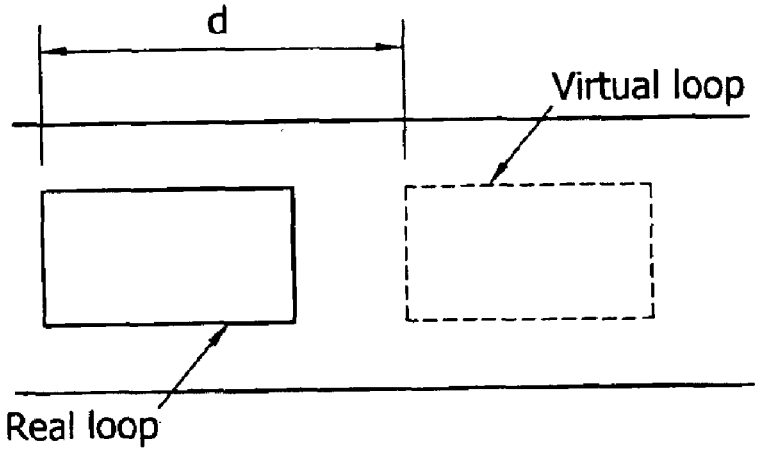
FIG. 17 illustrates the relative placement of the real loop and virtual loop for the single wire-loop speed estimation and communication system.

By detecting the enhanced inductive targets 906 on multiple wheels 1102 in sequence, the vehicle 1100 is identified uniquely, or quasi-uniquely as desired, identify the subject vehicle to the traffic-flow monitoring system. When the relative strength of the signals from each enhanced inductive target 906 is varied, for example by increasing the area of the enhanced inductive target 906, increasing the wire gauge of the secondary wire-loop 904, or decreasing the resistance of the wire of the secondary wire-loop 904, a multi-element identifier is established for the vehicle 1100. In the case of a tractor-trailer, an unique 18-element identifier is assigned to the vehicle unit. Such identifiers are desirable for commercial vehicle tracking, credentialing, pre-pass type systems, security, toll-tagging, etc. FIG. 13 illustrates one embodiment of a method for obtaining such identifiers.

A still further use for the enhanced inductive target 906 of the present invention is to indirectly measure tire inflation. When mounted on a wheel rim, the enhanced inductive target 906 produces a higher amplitude signal when the tire goes slack due to under inflation. Alternatively, underinflation is measured by noting differences in the circumference in the tire. Circumferential differences are observed by looking at the separation between reference points in the signature of the enhanced inductive target 906 carried by the wheel 1102. Detecting under inflated tires is known to have value for enhancing safety, efficiency, and for preventing congestion-causing traffic incidents.

C. Speed Determination from Single-Loop Sensor Configurations

In the prior-art, two wire-loops deployed in what is commonly referred to as the speed-trap configuration are typically used to determine vehicle speed with maximum reliability. The speed-trap configuration typically consists of an upstream loop sensor and a downstream loop sensor, which are deployed in the same traffic lane, together with a two-channel inductive loop detector card in communication with a field controller. Generally, the speed-trap configuration produces two bivalent output signals, one bivalent output signal for each wire-loop in the speed-trap. The respective bivalent outputs generated by the two-channel inductive loop detector card are sampled by the field controller (e.g., 170, 2070, or NEMA controller) that computes speed and lane occupancy based on the pulse timing of the bivalent outputs from the two detector channels. However, when there is only one loop sensor in a lane, only one bivalent output pulse from the lane is available to be sampled by the field controller; and in this case, speed and lane occupancy data can not be derived by the field controller.

More recently it has become known in the art that speed may be inferred from a single wire loop, typically as a function of the slew rates on the rising and falling edges of an inductive signature. See "Real-Time Traffic Measurement from Single Inductive Loop Signatures," by Seri Oh, et al., *Transportation Research Record* 1804—*Transportation Data and Information Technology Research*, pp. 98–106 (2002). However, the single wire-loop speed estimation techniques described therein are not applicable using conventional field controllers, which calculate speed from two bivalent signals.

In one embodiment of the present invention, an inductive loop detector card is connected to a single wire-loop sensor in a traffic lane. The detector card produces a first bivalent output based on the actual measurement of a vehicle at the wire-loop sensor and synthesizes a second bivalent output to mimic the output of a two wire-loop speed trap. The first bivalent output of the inductive vehicle detector card corresponds to the presence or absence of a vehicle at the single wire-loop sensor. The second bivalent output of the inductive vehicle detector card corresponds to the inferred presence or absence of the vehicle at a second "virtual" wire-loop sensor. In order to synthesize the second bivalent output, vehicle speed and lane occupancy are inferred from the inductive signature of the vehicle as measured at the wire-loop. A data processor onboard the detector card estimates the speed using an algorithm similar to that described by Oh, et al.

One method for calculating the second bivalent output shown in FIGS. 14–17 and described as follows. First assume a virtual loop separation, d. The virtual loop separation distance d is the longitudinal downstream distance from real loop to the virtual loop. Second, apply the single loop speed estimation algorithm and take the inductive vehicle signature to produce an estimated vehicle speed s, based on vehicle classification. Then, divide the distance d by the speed s to yield the delay $t_0$ used to trigger the bivalent output of the "virtual" loop. The pulse-width $t_1$, recorded from the real loop is used for the virtual loop on-time, $t_2$.

Though the virtual wire-loop sensor does not physically exist, it is possible to infer a bivalent output pulse for this virtual wire-loop, as if it did physically exist, from the inferred speed and known lane occupancy of a detected vehicle over the single wire-loop sensor. Commonly used field controllers can readily interpret the speed and lane occupancy information encoded in the two bivalent output pulses of the present invention. The field controllers sample the outputs of the detectors at discrete intervals. The intervals affect the accuracy of the speed calculations and bivalent on-times. For example, if a field controller samples at 60 samples per second, the quickest bivalent output change is approximately 17 milliseconds. Field controllers with faster sampling rates yield more accurate speed calculations. Speed estimates without loss of resolution are achieved by using discrete intervals less than or equal to the sampling rate of the controller. To keep the speed estimates within a reasonable range, an upper and lower limit can be set and adjusted based on application (e.g. <150 MPH, >1 MPH).

Figure 18:
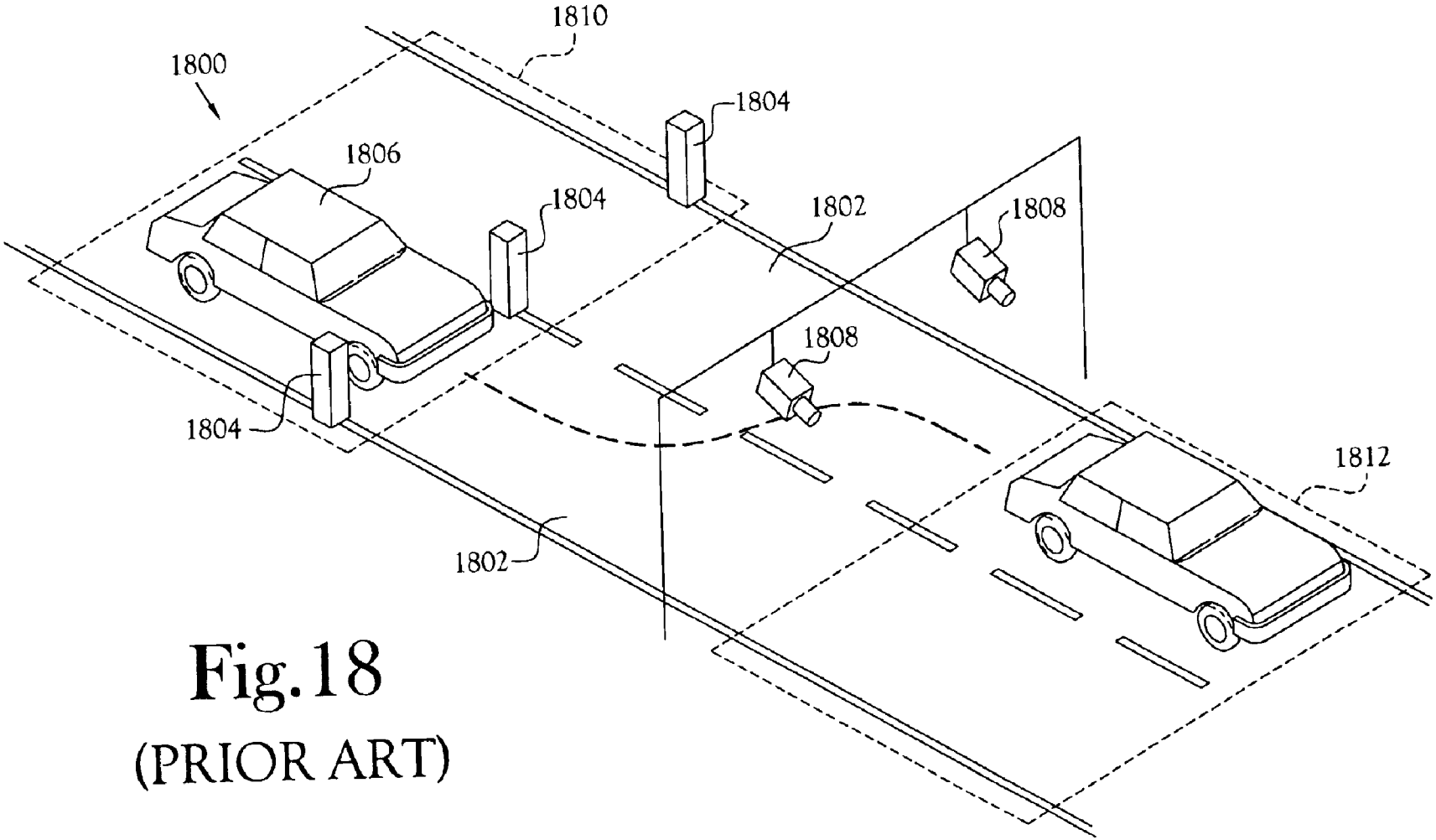
Fig. 18 (PRIOR ART)
FIG. 18 illustrates a conventional automated toll collection center incorporating automated enforcement.

D. Enhanced Vehicle Identification Reliability for Automated Enforcement Applications It is common in automated enforcement applications (e.g., where traffic citations are issued based in information provided by automated cameras that record vehicle license plate numbers) for automated citations to be issued to the wrong person because the camera recording the license plate number of the vehicle is triggered asynchronously from the vehicle detector that determines a violation has occurred. FIG. 18 illustrates a conventional automated toll collection center 1800 using automated enforcement. On toll-roads where electronic toll-tags are currently being used (e.g., EZ-Pass), there are typically dedicated traffic lanes 1802 equipped with toll-tag readers 1804 in an infraction monitoring zone 1810 for use by vehicles with established toll-tag accounts. When a vehicle uses one of these lanes 1802 without a valid toll-tag, an automated license-plate reading camera 1808 in a camera zone 1812 is triggered downstream to begin the process of issuing an automated citation to the vehicle owner. In practice however, the downstream license-plate reading camera 1808 sometimes takes a picture of the wrong vehicle, and the resulting legal controversy ends up costing the toll-road operator more in legal fees and loss of good will than is desirable.

Figure 19:
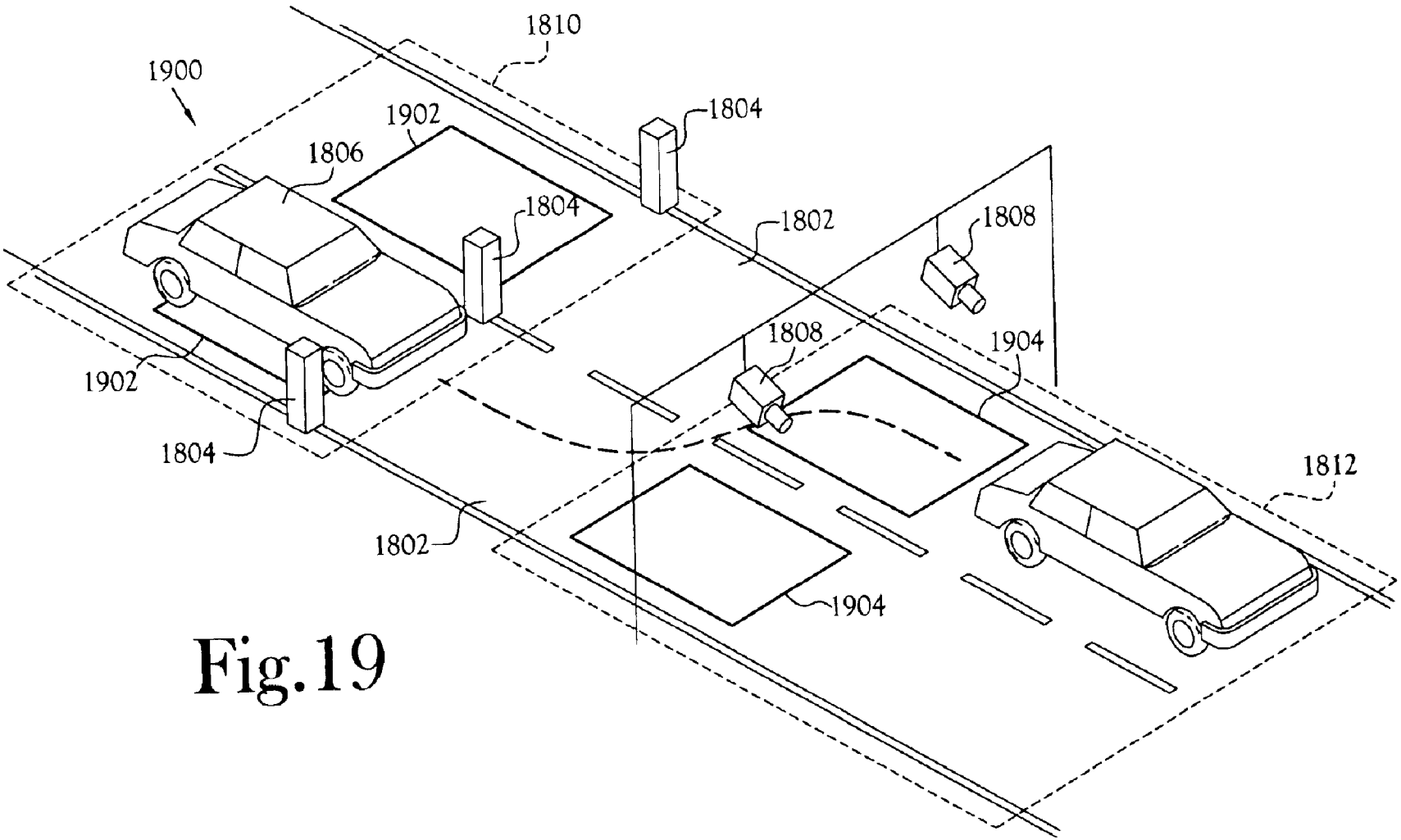
FIG. 19 illustrates an enhanced toll collection center incorporating vehicle characteristic monitoring in conjunction with the automated enforcement system.
Figure 20:
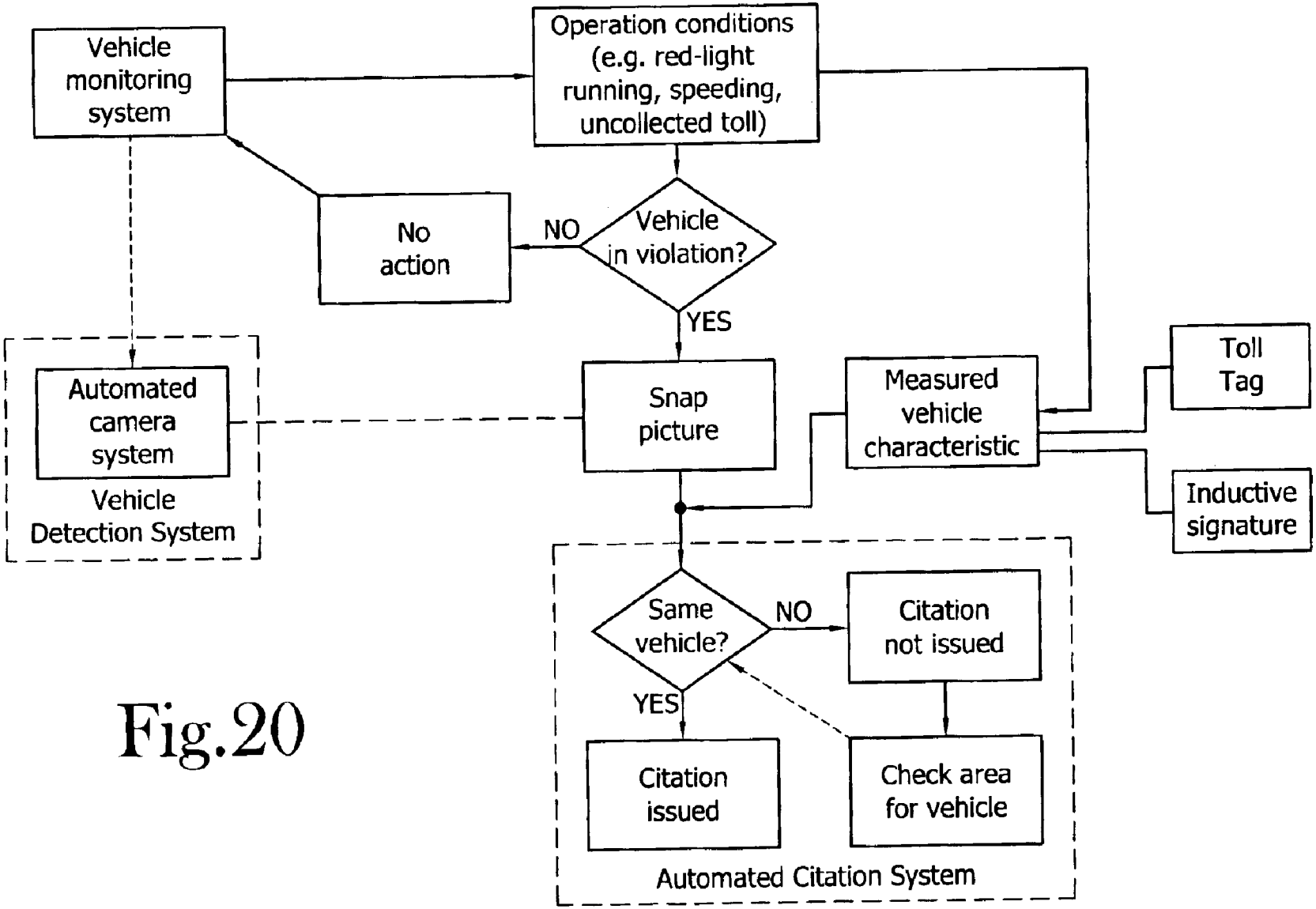
FIG. 20 generally illustrates a flow chart of one embodiment of the citation verification method of the present invention
Figure 21:
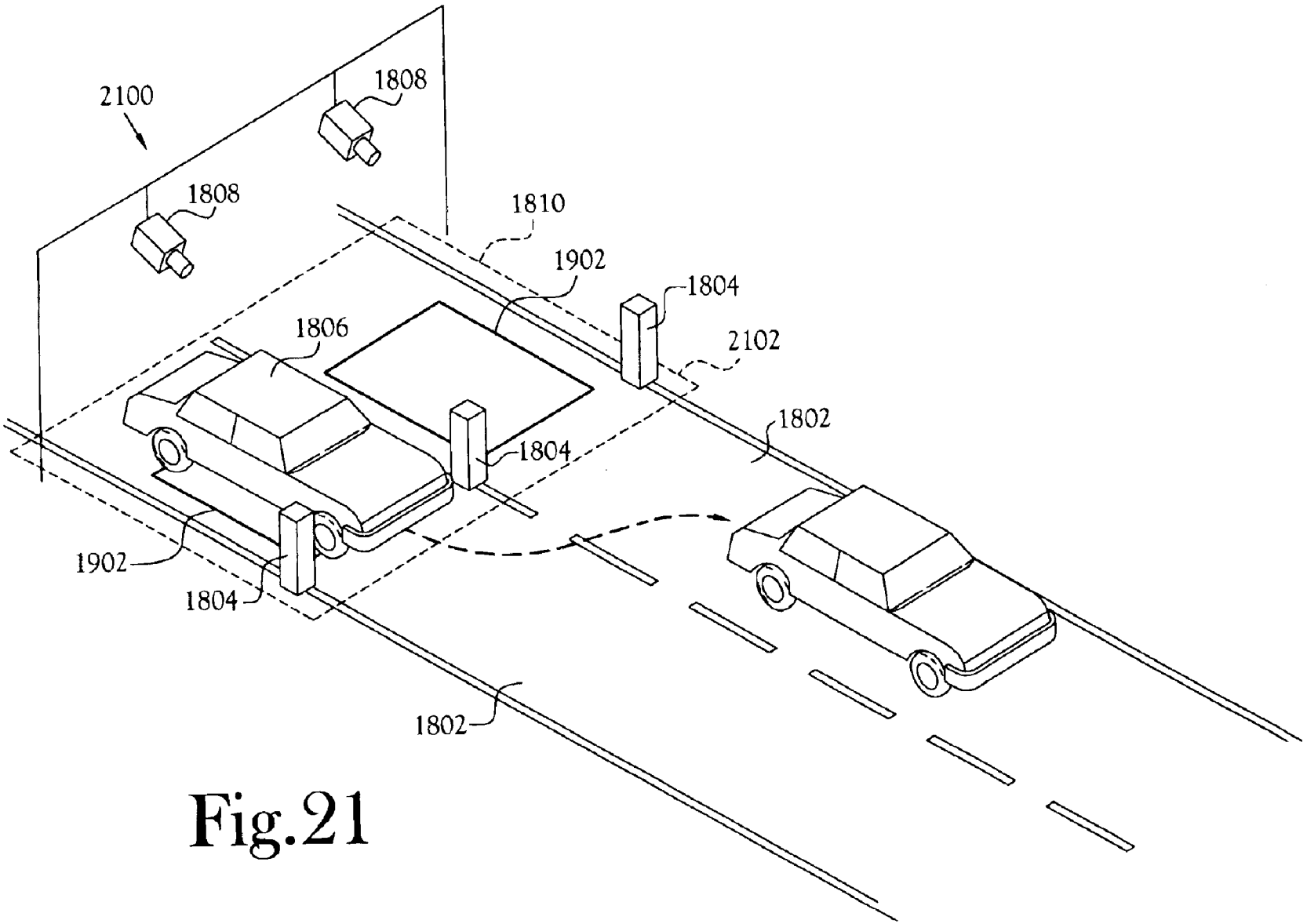
FIG. 21 illustrates an alternative embodiment of an automated enforcement system used in conjunction with an automated toll collection system.

FIG. 19 illustrates an automated toll collection center incorporating vehicle characteristic monitoring in conjunction with the automated enforcement system. In one embodiment of the present invention, each traffic lane 1802 is equipped with a vehicle identification system 1902, such as an inductive vehicle detector, located in the infraction monitoring zone 1810 that measures a physical characteristic of each vehicle contemporaneously with the violation-determining event (e.g., red-light running, speeding, or toll-tag reader). A second vehicle identification system 1904 is located in each traffic lane 1802 of the camera zone 1812 to measure a physical characteristic of each vehicle to be photographed is also measured contemporaneously. When an automated enforcement mechanism is initiated (e.g., taking a picture of a license-plate for subsequent issuance of a citation) the physical characteristic measured contemporaneously with the violation-determining event is compared with the physical characteristic measured contemporaneously with the license-plate reading event to verify that the same vehicle determined to be in violation of some condition is the same vehicle for which the citation is being issued. When the two vehicles are found to be not the same vehicle, the citation is not issued; when they are found to be the same vehicle, the evidence corroborating that the citation has been properly attributed to the violation-producing vehicle becomes part of the record supporting the validity of the citation. Also, when the two vehicles are found not to be the same vehicle, a search of physical characteristics measured for other vehicles in the area is made to locate the correct vehicle and to initiate the issuance of a citation to the correct vehicle. The physical characteristic measured is an inductive signature of the vehicle and/or any combination of a timestamp, speed, length, signature profile, or acceleration that serves to narrow down the possible downstream match for an upstream violation-determining event. FIG. 20 generally illustrates a flow chart of one embodiment of the citation verification method described herein. An alternative embodiment of an automated enforcement system 2100 is to have the camera zone and infraction monitoring zone at the same location 2102, as shown in FIG. 21. This method greatly decreases the chance to take a picture of a vehicle not violating the operating conditions.

F. Traffic-Flow Monitoring System Using Look-Ahead Simulation

Figure 22:
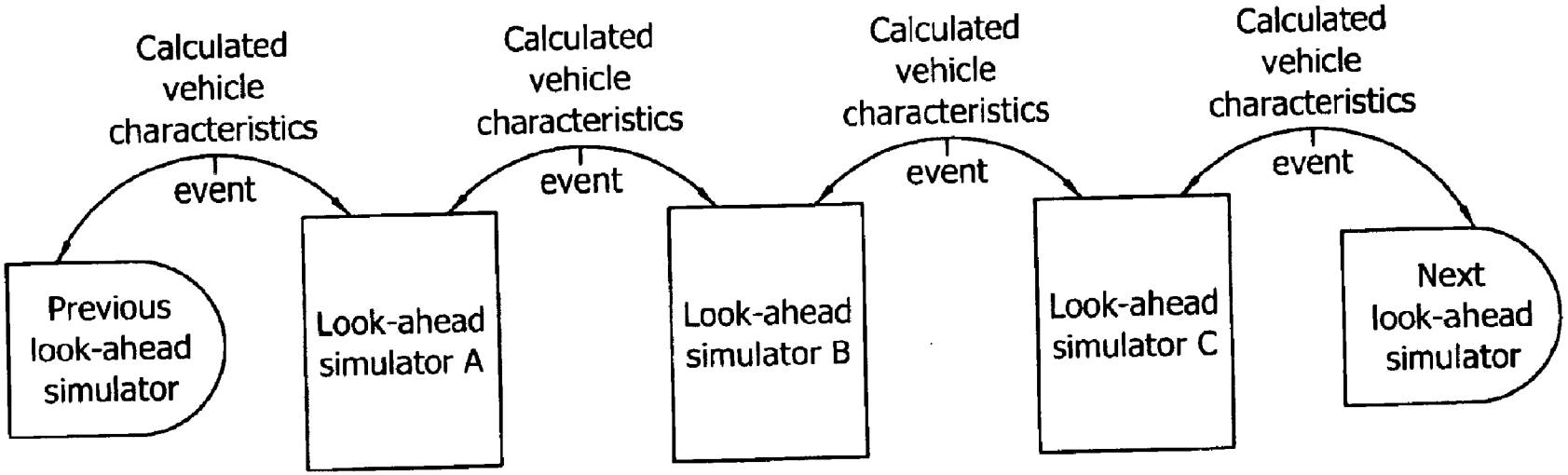
FIG. 22 illustrates a flow diagram of a look-ahead simulator system data flow.
Figure 23:
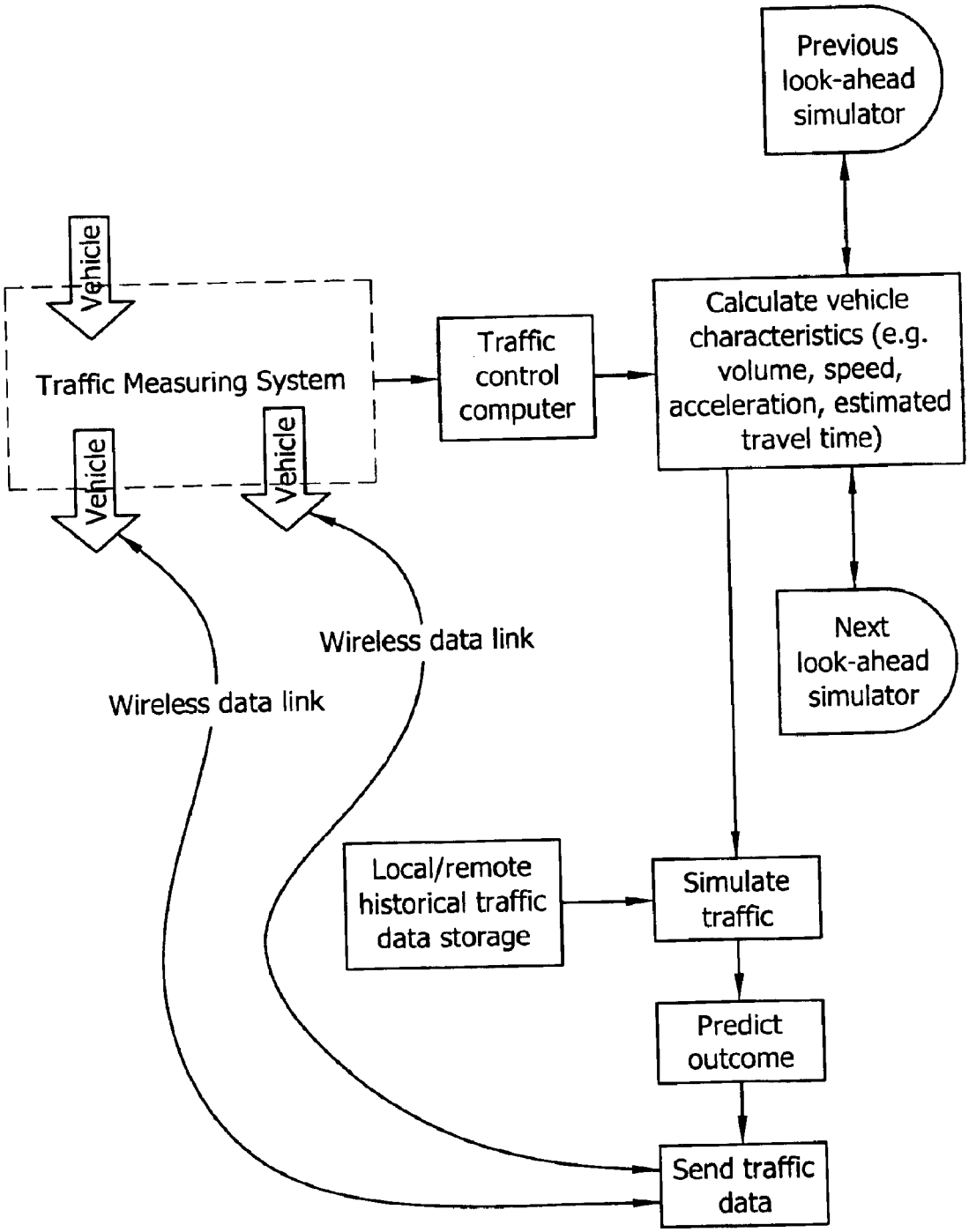
FIG. 23 illustrates a flow diagram of the look-ahead simulator system.
Figure 24:
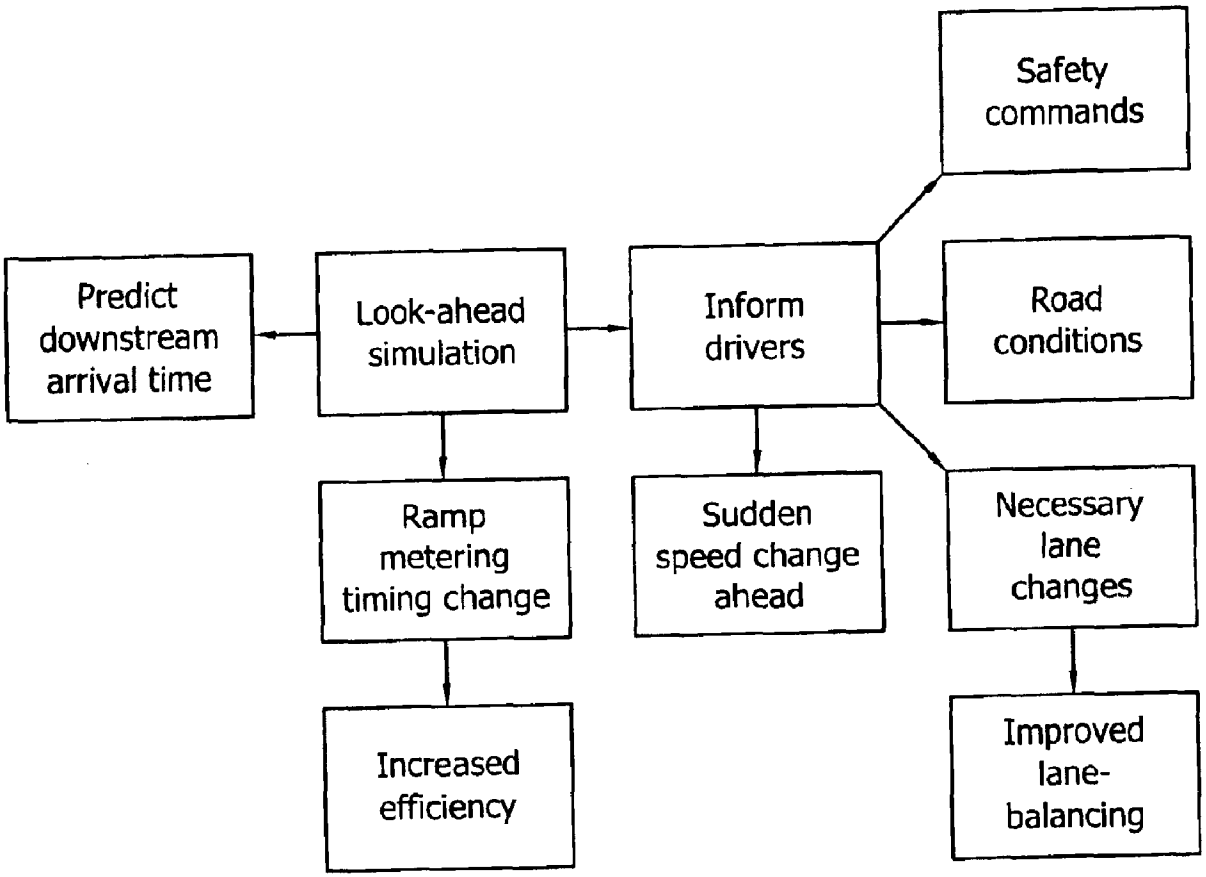
FIG. 24 illustrates a block diagram of the functions of the look-ahead simulator system.

FIGS. 22–24 illustrate one embodiment of a method for traffic-flow monitoring using look-ahead simulation. Generally, the location and speed of a vehicle is determined by a traffic measurement system. The traffic measurement system includes one or more of the following devices: a fixed-point vehicle detector, a roadway section vehicle detector, or a vehicle probe circuit located on the vehicle itself. In each case, the speed and location of a vehicle becomes known to a traffic control computer. With similar knowledge of recent traffic-flow past the same traffic measurement system, information from a majority of other vehicles on the roadway, a look-ahead simulation predicts decelerations and lane-changes. This information is used to increase the welfare of individual motorists, and all motorists as a group through enhanced safety, throughput, and/or peak carrying capacity of the roadway. These predicted deceleration and/or lane changes are communicated to individual motorists, or to all motorists as a group. Conditions that are typically predictable by a look-ahead simulation include forced decelerations for higher-speed vehicles, and/or lane-change recommendations. When a freeway is operating near its peak volume capacity, predicted decelerations become more numerous, and lane-balancing recommendations, when acted upon by selected individual motorists, can increase the effective peak volume capacity of the roadway. With feedback from a downstream vehicle re-identification system, the look-ahead simulator can more effectively evaluate the effect of the recommendations made to the motorists and modify its models of driver behavior accordingly.

Look-ahead simulation is used to project a fixed-point detector downstream to a "virtual" location. This application is useful for comparing the outputs of two different detection devices when it is not convenient to have them at the same location. Reasons due to various installation issues among others. The look-ahead simulation predicts when a vehicle will pass particular section of the highway by using the vehicle characteristics previously recorded. Using the vehicle speed and time of detection the simulation then predicts when the vehicle will pass a certain point downstream based on the longitudinal downstream distance. A new time stamp is generated based on the calculated time it will take the vehicle to travel the distance, given the speed of the vehicle. For more accurate estimates, other vehicle characteristics, such as vehicle classification, vehicle length, vehicle weight, road conditions, among others could be used to yield better predictions. In summary, look-ahead simulation allows: (a) prediction a downstream arrival time for a vehicle; (b) modification of the timing of a ramp-metering signal to increase ramp-metering efficiency; and (c) communication of a suggestion, command, or condition to a motorist to incite said motorist to change lanes, that improves lane-balancing, and reduces the need for sudden speed changes.

G. Dynamic Adjustments to Driver Behavior Models

Figure 25:
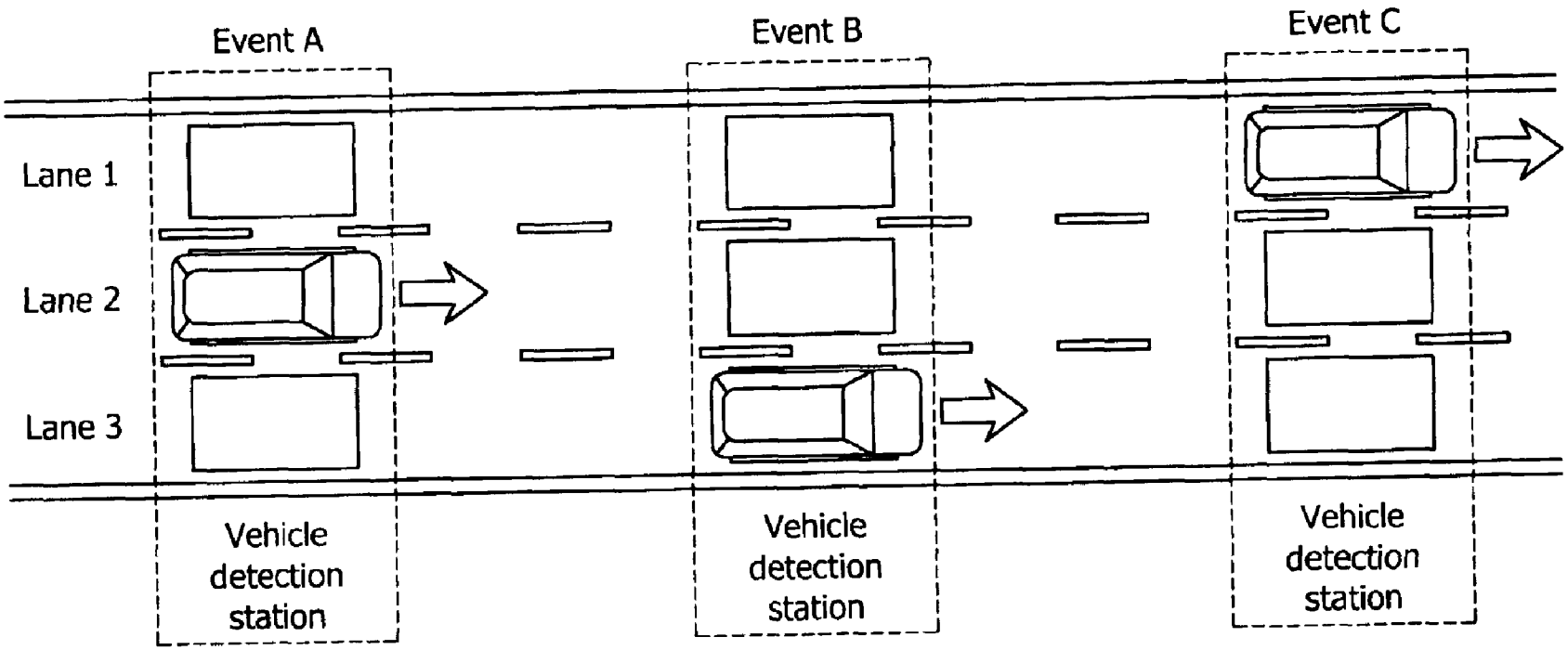
FIG. 25 illustrates vehicular events in a driver behavior modeling scenario.
Figure 26:
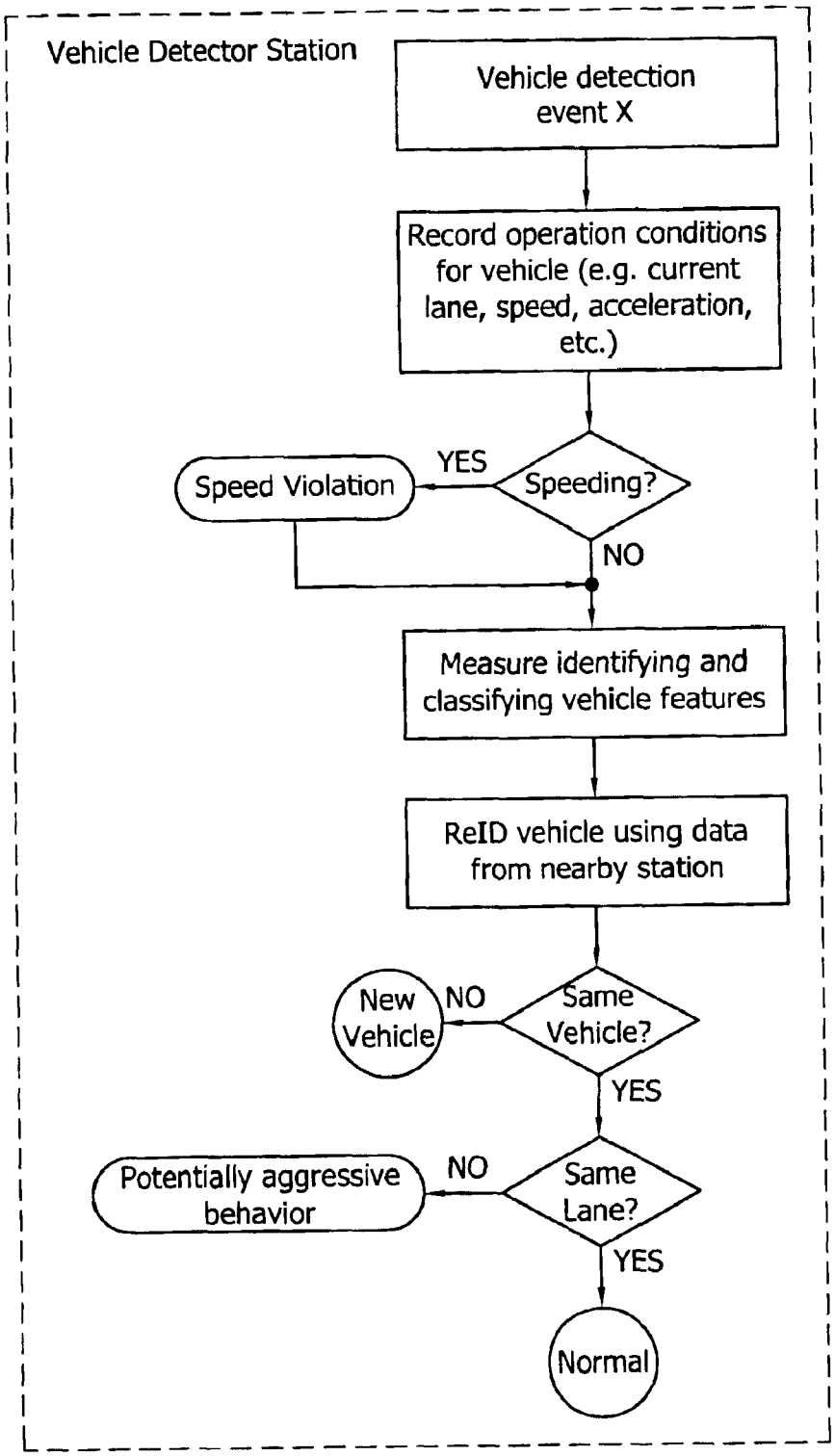
FIG. 26 illustrates a block diagram of method of modeling driver behavior at a vehicular detector station.
Figure 27:
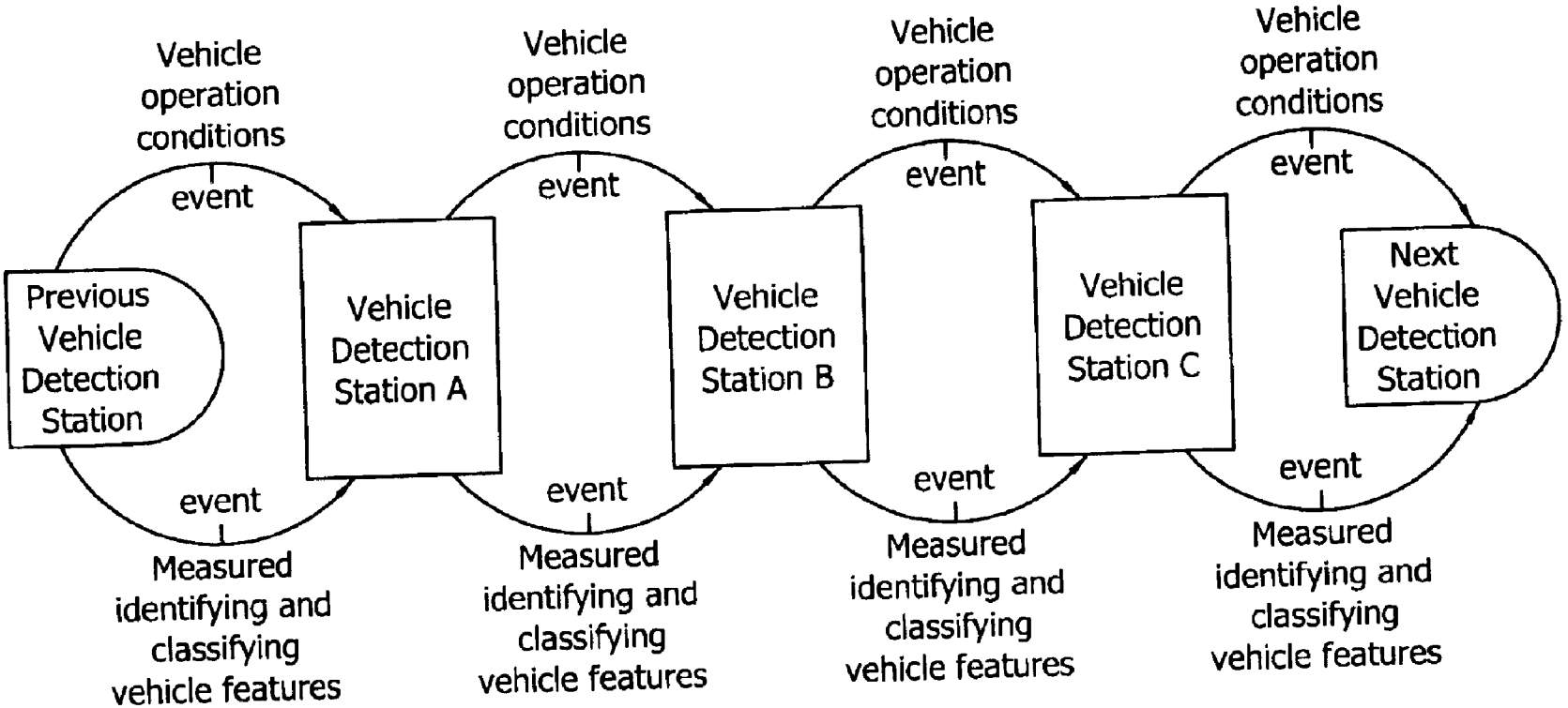
FIG. 27 illustrates system data flow in a system for modeling driver behavior.

Once the speed and location of a vehicle is detected, the expected behavior of the driver, in combination with an assumed vehicle kinematics model and with knowledge of the current traffic conditions such as roadway geometry, and current traffic conditions is simulated. In one embodiment of the present invention, a classification of the vehicle is also detected and the vehicle kinematics model is calibrated according to the classification of the vehicle. For example, the inductive length of the vehicle is readily measured using an advanced inductive loop vehicle detector. Some of the parameters of the kinematic model of the vehicle that are calibrated as a function of the measured inductive length include: vehicle mass, engine power, frontal area, and desired time headway. By tracking the vehicle through a plurality of detection sites along the roadway, the diver behavioral model associated with each vehicle is re-calibrated as more in-context observations of the vehicle are made. FIG. 25 illustrates measured events and FIGS. 26 and 27 generally illustrate the method for developing a driver behavior model.

While the present invention has been illustrated by description of several embodiments and while the illustrative embodiments have been described in detail, it is not the intention of the applicant to restrict or in any way limit the scope of the appended claims to such detail. Additional advantages and modifications will readily appear to those skilled in the art. The invention in its broader aspects is therefore not limited to the specific details, representative apparatus and methods, and illustrative examples shown and described. Accordingly, departures may be made from such details without departing from the spirit or scope of applicant's general inventive concept.

I claim:

1. A method for communicating at least one of vehicle speed and vehicle length information gathered from a vehicle detector, said method comprising the steps of:

a) measuring at least one of a vehicle speed and a vehicle length using a vehicle detector during a first vehicle detection event;

b) constructing a first output pulse corresponding to said first vehicle detection event;

c) outputting said first output pulse on a first output channel associated with said vehicle detector;

d) inferring a second vehicle detection event from at least one of vehicle speed and a vehicle length obtained from said first vehicle detection event;

e) constructing a second output pulse corresponding to said second vehicle detection event; and f) outputting said second output pulse on a second output channel.

2. The method of claim 1 wherein said first output pulse comprises a first pulse-width, and wherein said second output pulse comprises a second pulse-width; and wherein said second pulse-width is substantially equal to said first pulse-width.

3. The method of claim 1 wherein said first output pulse comprises a first start-time, and wherein said second output pulse comprises a second start-time; and wherein the difference between said second start-time and said first start-time is chosen to substantially correspond to the quotient of a hypothetical offset distance divided by said vehicle speed, said hypothetical offset distance measured from said vehicle detector.

4. An apparatus for communicating at least one of vehicle speed and vehicle length information gathered from a vehicle detector, said apparatus comprising:

a) a means for measuring at least one of vehicle speed and a vehicle length during a first vehicle detection event;

b) a means for constructing a first output pulse corresponding to said first vehicle detection event;

c) a means for outputting said first output pulse on a first output channel corresponding to said means for measuring;

d) a means for inferring a second vehicle detection event using at least one of said speed and said vehicle length obtained from said first vehicle detection event;

e) a means for constructing a second output pulse corresponding to said second vehicle detection event; and f) a means for outputting said second output pulse on a second output channel.

5. The apparatus of claim 4 wherein said first output pulse comprises a first pulse-width, and wherein said second output pulse comprises a second pulse-width; and wherein said second pulse-width is substantially equal to said first pulse-width.

6. The apparatus of claim 4 wherein said first output pulse comprises a first start-time, and wherein said second output pulse comprises a second start-time; and wherein the difference between said second start-time and said first start-time is chosen to substantially correspond to the quotient of a hypothetical offset distance divided by said vehicle speed, said hypothetical offset distance measured from said vehicle detector.

7. A method for communicating at least one of vehicle speed and vehicle length information gathered from a vehicle detector, said method comprising the steps of:

a) measuring at least one of vehicle speed and a vehicle length using a first vehicle detector during a first vehicle detection event;

b) constructing a first output pulse corresponding to said first vehicle detection event;

c) outputting said first output pulse on a first output channel corresponding to said first vehicle detector, said first output pulse comprising a first pulse-width;

d) inferring from at least one of said speed and said vehicle length information a second vehicle detection event for a second vehicle detector;

e) constructing a second output pulse corresponding to said second vehicle detection event, said second output pulse comprising a second pulse-width, said second pulse-width being substantially equal to said first pulse-width; and f) outputting said second output pulse on a second output channel corresponding to said second vehicle detector.

8. A method for communicating at least one of vehicle speed and vehicle length information gathered from a vehicle detector, said method comprising the steps of:

a) measuring at least one of vehicle speed and a vehicle length using a first vehicle detector during a first vehicle detection event;

b) constructing a first output pulse corresponding to said first vehicle detection event, said first output pulse comprising a first start-time;

c) outputting said first output pulse on a first output channel corresponding to said first vehicle detector;

d) inferring from at least one of said speed and said vehicle length information a second vehicle detection event for a second vehicle detector;

e) constructing a second output pulse corresponding to said second vehicle detection event, said second output pulse comprising a second start-time, a difference between said second start-time and said first start-time being chosen to substantially correspond to the quotient of a hypothetical offset distance between said first vehicle detector and the second vehicle detector divided by said vehicle speed; and f) outputting said second output pulse on a second output channel corresponding to said second vehicle detector.

9. An apparatus for communicating at least one of vehicle speed and vehicle length information gathered from a vehicle detector, said apparatus comprising:

a) a means for measuring at least one of vehicle speed and a vehicle length during a first vehicle detection event;

b) a means for constructing a first output pulse corresponding to said first vehicle detection event, said first output pulse comprising a first pulse-width;

c) a means for outputting said first output pulse on a first output channel corresponding to said first vehicle detector;

d) a means for inferring from at least one of said speed and said vehicle length information a second vehicle detection event for a second vehicle detector, said second output pulse comprising a second pulse-width, said second pulse-width being substantially equal to said first pulse-width;

e) a means for constructing a second output pulse corresponding to said second vehicle detection event;

f) a means for outputting said second output pulse on a second output channel corresponding to said second vehicle detector.

10. An apparatus for communicating at least one of vehicle speed and vehicle length information gathered from a vehicle detector, said apparatus comprising:

a) a means for measuring at least one of vehicle speed and a vehicle length during a first vehicle detection event;

b) a means for constructing a first output pulse corresponding to said first vehicle detection event, said first output pulse comprising a first start-time;

c) a means for outputting said first output pulse on a first output channel corresponding to said first vehicle detector;

d) a means for inferring from at least one of said speed and said vehicle length information a second vehicle detection event for a second vehicle detector, said second output pulse comprising a second start time, a difference between said second start-time and said first start-time being chosen to substantially correspond to the quotient of a hypothetical offset distance between said first vehicle detector and the second vehicle detector divided by said vehicle speed;

e) a means for constructing a second output pulse corresponding to said second vehicle detection event; and f) a means for outputting said second output pulse on a second output channel corresponding to said second vehicle detector.

* * * * *